US005908736A

United States Patent [19]

Yamazaki

[11] Patent Number: 5,908,736

[45] Date of Patent: Jun. 1, 1999

[54] HEAT DEVELOPABLE SILVER HALIDE COLOR PHOTOGRAPHIC LIGHT-SENSITIVE MATERIAL AND A METHOD OF FORMING COLORED IMAGES

[75] Inventor: Takayasu Yamazaki, Kanagawa, Japan

[73] Assignee: Fuji Photo Film Co., Ltd., Kanagawa, Japan

[21] Appl. No.: 08/927,038

[22] Filed: Sep. 10, 1997

[30] Foreign Application Priority Data

Sep. 10, 1996 [JP] Japan ..... 8-261264

[51] Int. Cl.[6] ..... G03C 5/16; G03C 1/34

[52] U.S. Cl. ..... 430/351; 430/203; 430/600; 430/603; 430/611; 430/607; 430/609; 430/617

[58] Field of Search ..... 430/203, 351, 430/567, 603, 600, 611, 607, 609, 617

[56] References Cited

U.S. PATENT DOCUMENTS

| | | | |
|---|---|---|---|
| 4,021,240 | 5/1977 | Cerquone et al. . | |
| 4,713,319 | 12/1987 | Aono et al. | 430/567 |
| 5,275,930 | 1/1994 | Maskasky | 430/567 |
| 5,316,886 | 5/1994 | Koide et al. | 430/203 |

FOREIGN PATENT DOCUMENTS

| | | |
|---|---|---|
| 0617318 A2 | 9/1994 | European Pat. Off. . |
| 0653669 A1 | 5/1995 | European Pat. Off. . |
| 0722119 A1 | 7/1996 | European Pat. Off. . |

*Primary Examiner*—Thorl Chea
*Attorney, Agent, or Firm*—Sughrue, Mion, Zinn, Macpeak & Seas, PLLC

[57] ABSTRACT

The present invention discloses a heat developable silver halide color photographic light-sensitive material comprising a support having thereon photographic constituent layers which comprise at least one photographic light-sensitive layer comprising a light-sensitive silver halide emulsion, a developing agent, a compound capable of forming a dye by a coupling reaction with the oxidation product of the developing agent, and a binder, wherein at least one photographic constituent layer contains at least one of the compounds expressed by the formula (I), (II), (III), or (IV) below, and wherein at least 50% of the total projected area of silver halide grains contained in the light-sensitive silver halide emulsion is taken up by tabular silver halide grains at least 50% of which are composed of silver chloride.

As a result, a heat developable silver halide color photographic light-sensitive material which minimizes adverse effects on the environment and which is suitable for simple and rapid process and which has high sensitivity and the finished print obtained by which has low fogging is presented.

Formula (I)

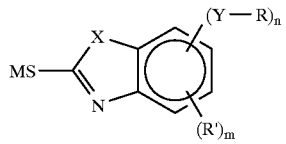

Formula (II)

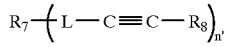

Formula (III)

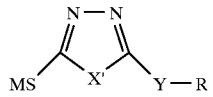

Formula (IV)

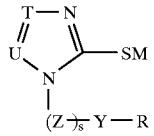

11 Claims, No Drawings

HEAT DEVELOPABLE SILVER HALIDE COLOR PHOTOGRAPHIC LIGHT-SENSITIVE MATERIAL AND A METHOD OF FORMING COLORED IMAGES

BACKGROUND OF THE INVENTION

1. Field of the Invention

The present invention relates to a heat developable silver halide color photographic light-sensitive material and to a method of forming colored images. To be more specific, it relates to a heat developable silver halide color photographic light-sensitive material which does little harm to the environment, and is suitable for simple and rapid image formation. What is more, it relates to a silver halide color photographic light-sensitive material, having a high speed of sensitivity and low fogging. Also the present invention relates to a simple and rapid process of forming colored images by using said heat developable silver halide color photographic light-sensitive material, in which process the environment is not adversely affected and the finished prints can have low fogging.

2. Description of the Related Art

Over the past few years light-sensitive materials which use silver halides for color photography have developed so much that now it is very easy to get high quality color images. For example, in what is usually called the color photographic method, color negatives are used for camera use, and after development the image information recorded on the negatives is optically printed onto color photographic paper to give the color prints.

In recent years this process has developed to a high level and large amounts of color printing can be produced on a large scale efficiently. Compact and simple printing processers set up in color printing labs or shops (the so called mini-labs) make color photography easy and fun for all.

The color photography now in common use reproduces color by the subtractive color process. Generally, a color negative film comprises a transmittable support and light-sensitive layers thereon utilizing a silver halide emulsion as a light-sensitive component having a sensitivity to the blue, green or red wavelength region of the spectrum, and a so-called color coupler capable of producing a yellow, magenta or cyan dye as a complementary hue of the sensitive wavelength region of the respective layers. A color negative film which has been exposed imagewise, is developed in a color developer containing an aromatic primary amine developing agent. In this process, the developing agent develops, i.e., reduces the exposed silver halide grains and the oxidation product of the developing agent formed during the foregoing reduction, and undergoes a coupling-reaction with the color coupler to form a dye. The silver (developed silver) generated by the color development and the unreacted (unexposed) silver halide are removed by means of a bleaching and fixing process. This creates an image on the color negative film. Consequently, color photographic paper which comprises a reflective support and light-sensitive layers formed thereon having the same combinations of light-sensitive wavelength region and hue to be produced as in the color negative film, is subjected to exposure through the developed negative film, and color-developing, bleaching and fixing the color photographic paper in the same manner as in the case of the negative film to obtain a color print having a color image as a reproduction of an original image thereon.

Although these systems are widely adopted at the moment, there is a growing demand for a simpler system.

The first reason for this is that expertise and skilled operators are necessary due to the requirement of strict control of the composition and the temperature of the processing solution in a processing bath for the above procedure composed of color development, bleaching and fixing. The second reason for this is that closed equipment used exclusively in the developing process is often required, due to substances, such as a developing agent and, as a bleaching agent, an iron chelate compound, the discharge of which is regulated from the standpoint of environmental protection, contained in the processing solution. The third reason for this is that the currently available system does not perfectly fulfill the requirements for rapid reproduction of images, as the above developing process still requires a long time.

In recent years many technical improvements have been presented as a result of this background. Many techniques involving the use of emulsions containing high levels of silver chloride have been presented with the specific aim of developing simple and rapid developing processes. By using such emulsions, advantages like speeding up development, and increasing the re-usability of the processing solutions can be realized. Because of this, the majority of printing light-sensitive materials in use today are printing light-sensitive materials, such as color photographic paper, using such emulsions.

U.S. Pat. Nos. 5,264,337, No. 5,292,632, No. 5,310,635, and WO 94/22054 and others disclose the use of an emulsion having a high content of silver chloride tabular grains, made up of a (100) plane, in a color photographic light-sensitive material as a technique utilizing an emulsion having a high content of silver chloride to a photographic light-sensitive material for the purpose of speeding up the developing process. These techniques obtain high speed development through the use of high level silver chloride emulsions. Also there are such advantages as being able to use the same processing solution for both photographic light-sensitive materials and for printing light-sensitive materials. However, development processing with processing solutions has always been necessary which is environmental problem.

On the other hand, as attempts different from these, a simpler system which does not utilize the developing agent and bleaching agent now in use for a conventional color image forming system and which accordingly minimizes the adverse effects on the environment has been reported on. For example, IS&T's $48^{th}$ Annual conference Proceedings, p.180, discloses a system for carrying out a developing process without the use of a bleach-fixing bath, which has traditionally been indispensable in the conventional photographic process. The procedure comprises transferring the dye formed in the developing reaction to a mordant layer and thereafter stripping a light-sensitive material from an image receiving material bearing the mordant layer so that the developed silver and unreacted silver halide are removed. However, even this technique does not solve the environmental problems perfectly because the developing process still needs the processing bath.

Fuji Photo Film Co., Ltd. has proposed the Pictography System which dispenses with the need for a processing solution containing a color developing agent. In this Pictography System, the dyes formed in the development are fixed in the dye fixing layer. This is suitably used as a dye image for appreciation of images. This Pictography System comprises supplying a small amount of water to a light-sensitive material containing a base precursor and plying the light-sensitive material with an image receiving material and thereafter heating the materials to cause a developing reaction. This procedure does not use the aforementioned processing bath, and in this regard is advantageous with respect to the environment. It is possible to apply such a non-processing-solution-system to the processing of color photographic recording materials in order to solve the above problems.

However, when using high concentration silver chloride emulsions for colorphotographic light-sensitive materials to be heat-developed without the above processing solutions to enable rapid processing, various problems with the developing characteristics of the emulsions arise. Firstly, in order to get good graininess, it becomes necessary to inhibit the development of the grains which initiate the development while the process is still running. But when heat developable light-sensitive materials using high concentration silver chloride emulsions, it becomes difficult to inhibit the development because the rate of development is so high. As a result the graininess deteriorates. When the development is inhibited at a level where the graininess does not deteriorate, the development initiation timing of the light-sensitive grains becomes inconsistent, and it becomes more difficult to get a sensitive photographic response in the early stages of development. Secondly, fogging due to the high developability of the high concentration silver chloride emulsions, and the high temperature development becomes extremely high.

The combination of (100) plane, tabular silver chloride emulsion with the development inhibitor (mercaptotetrazoles, mercaptooxathiazol, benzotriazoles etc.) is outlined in the specification of WO94/22,054, noted above. However, nothing is mentioned in it about prevention of fogging in heat development.

The combination of (100) plane, tabular silver chloride emulsion with heat development is disclosed in Japanese Patent Application Publication (JP-B) No. 7-120014, but this disclosure concerns a method of image formation through the use of dye-providing chemicals. Mention of fogging resistance with regard to the light-sensitive materials used in the coupling reaction heat development is not made. Silver bromide and silver chlorobromide containing 80% silver bromide were given as examples. Fogging prevention due to concentrated silver chloride was not satisfactorily disclosed, and as a result, research into fogging prevention brought about by concentrated silver chloride emulsions of the light-sensitive materials presented in coupling reaction heat development has long been due.

SUMMARY OF THE INVENTION

One of the objects of the present invention is to present a heat developable silver halide color photographic light-sensitive material which minimizes adverse effects on the environment and which is suitable for simple and rapid process and which has high sensitivity and the finished print obtained by which has low fogging.

Another objective of the present invention is to present a method of forming color images through the use of a heat developable silver halide color photographic light-sensitive material like that of the present invention rapidly, simply and in a state of reduced fogging while reducing harmful affects on the environment. The above problems were solved in the following way:

(1) A heat developable silver halide color photographic light-sensitive material comprising a support having thereon photographic constituent layers which comprise at least one photographic light-sensitive layer comprising a light-sensitive silver halide emulsion, a developing agent, a compound capable of forming a dye by a coupling reaction with the oxidation product of the developing agent, and a binder, wherein at least one photographic constituent layer contains at least one of the compounds represented by formulas (I), (II), (III), or (IV) below, and wherein at least 50% of total projected area of silver halide grains contained in the said light-sensitive silver halide emulsion is taken up by tabular silver halide grains at least 50% of which are composed of silver chloride.

Formula (I)

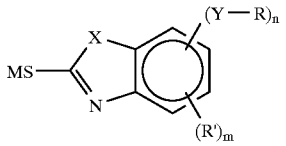

In the formula (I), Y represents —N($R_1$)—$SO_2$—, —N($R_2$)—$SO_2$—N($R_3$)— or —N($R_4$)—CO—N($R_5$)—, R represents an alkyl group, an alkenyl group, a cycloalkyl group, an aryl group, or an aralkyl group; x represents O—O, —S— or —N($R_6$)—; M represents a hydrogen atom, an alkali metal atom, an ammonium group, or a group that cleaves under alkaline conditions; R' represents a hydrogen atom, or a group substitutable with a hydrogen atom; $R_1$–$R_6$ represent hydrogen atoms or alkyl groups; n represents 0, 1, or 2; m represents 4-n.

Formula (II)

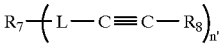

In the formula (II), L represents a single or divalently bonded group, n' represents an integer of 1–4, when n' is 1, $R_7$ is a carboxyl group, an alkyl group, a cycloalkyl group, an alkenyl group, an alkynyl group, an aralkyl group, an aryl group, or a heterocyclic group; when n' is 2, 3, or 4, $R_7$ represents a di, tri, or tetravalent residue; $R_8$ represents a hydrogen atom, a carboxyl atom, an alkyl group, a cycloalkyl group, an alkenyl group, an alkynyl group, an aralkyl group, an aryloxycarbonyl group, an alkoxycarbonyl group, an aryl group, a heterocyclic group, or a carbamoyl group; when n' is 2, 3, or 4, the residue, apart from the $R_7$ part, may all be the same or different, but not when L is a single bond and n'=1.

Formula (III)

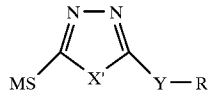

In the general formula (III), X' represents —O—, —S—, or —NH—; Y, R and M represent the same as they represented respectively in the formula (I).

Formula (IV)

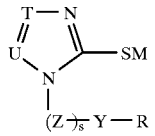

In the formula (IV), T and U represent —C($R_9$)— or —N═; $R_9$ represents a hydrogen atom, a halogen atom, a hydroxy group, a nitro group, an alkyl group, an alkenyl group, an aralkyl group, an aryl group, a carboxylic acid amide group, a sulfonamide group, an ureide group, or a thioureide group; Z represents an alkylene group, an alkenylene group, an aralkylene group, or an arylene group; s represents 0 or 1, Y, R, and M represent the same as they do respectively in the formula (I).

(2) A method of forming color images comprising; exposing a heat developable silver halide color photographic light-sensitive material which comprises a support and photographic constituent layers formed thereon, said photographic constituent layers comprising at least one light-sensitive layer, said light-sensitive layer containing a light-sensitive silver halide emulsion, a developing agent, a compound capable of forming a dye by a coupling reaction with the oxidation product of the developing agent, and a binder; supplying water to the light-sensitive surface of the heat developable silver halide color photographic light-sensitive material or a processing surface of a processing material comprising a support and a constituent layer thereon which comprises the processing layer containing a base or a base precursor, in an amount ranging from 1/10 to the equivalent of an amount which is required for the maximum swelling of all the coated layers of these materials; plying the light-sensitive material and the processing material so that the light-sensitive surface comes into contact with the processing surface; and heat developing the materials to form a color image;

wherein at least 50% of total projected area of silver halide grains contained in said light-sensitive silver halide emulsion of said heat developable silver halide color photographic light-sensitive material is taken up by tabular silver halide grains at least 50% of which are composed of silver chloride, and wherein said heat developing is carried out under at least one compound represented by the above formula (I), (II), (III) or (IV).

DESCRIPTION OF THE PREFERRED EMBODIMENTS

The present invention will now be explained in detail.

In the heat developable silver halide color photographic light-sensitive material of the present invention, at least one of the light-sensitive layers contains a light-sensitive silver halide emulsion containing silver halide grains made up of at least 50 mole % silver chloride.

The silver halide grains are tabular grains the outer surface of which is composed of a (100) plane, the projected plane of which is in the shape of a rectangle and having a length to breadth ratio of from 1:1 to 1:2, and whose aspect ratio is more than 2.

In the present invention, at least 50% of the projected area of the silver halide grains of the light-sensitive silver halide emulsion is taken up by tabular grains, preferably at least 70%.

In the present invention, the term aspect ratio refers to the value arrived at by dividing the diameter of a circle having the same area as the projected area by the thickness of the grains. In the present invention, the aspect ratio of the silver halide grains is at least 2, preferably at least 5, more preferably at least 8, and most preferably at least 15. There is no specified upper limit to this aspect ratio, but if the thickness of the grains is less than 0.01 μm, pressure resistance decreases, which is not desirable.

Because most of the outer surface of the silver halide grains of the present invention is composed of a (100) plane, the projected plane is rectangular. It is necessary that the length to breadth ratio of the rectangular projected plane be within the range of from 1:1 to 1:2. In other words, the present invention cannot be effective if an emulsion composed of rod-like, cubic or similar rectangular parallelopiped grains is used. In the present invention, tabular grains with almost square projected planes are preferable.

The shapes of these silver halide grains can be analyzed by the carbon replica method which entails shadowing latex balls and the silver halide grains with heavy metals. The latex balls serve as a standard for the determination of grain size. The grains are then viewed under an electron microscope to assess the grain shapes.

The composition of the halides in the light-sensitive silver halide emulsion used in the present invention uses silver chlorobromide, silver chloroiodide, silver chlorobromoiodide, or silver chloride, but consists of at least 50 mole % of silver chloride.

The light-sensitive silver halide emulsion used in the present invention may contain silver iodide, but preferably at a level of no greater than 6 mole %, or more preferably no greater than 2 mole %. It is preferable that the present invention uses a light-sensitive silver halide emulsion comprising silver halide grains containing a laminated structure made up of several layers of different halogen compositions. The silver halide grains are preferably 0.1–10 μm in size, when expressed as the diameter of a circle having the same projection area, 0.3–5 μm is more preferable, and 0.5–4 μm is most preferable.

Including known methods, there are a number of ways of producing light-sensitive silver halide emulsions containing tabular silver halide grains which comprise at least 50% silver chloride, whose main outer surface is composed of a (100) plane, whose projected plane is rectangular with a length to breadth ratio of from 1:1 to 1:2, and whose aspect ratio is 2 or more. For example, methods outlined in the following disclosures may be used: Japanese Patent Application Laid Open (JP-A) Nos. 5-204073, 51-88017, 63-24238, and 7-146522.

During preparation of the tabular grains, a method for forming nucleuses which develop into a tabular state is necessary. In the same way as in the methods listed above, during the early stages of formation of the grains, it is effective to add iodide ions, bromide ions, or compounds which exhibit selective absorption in special surfaces to the solvent used for the preparation of the emulsion.

The light-sensitive layers of the silver halide color photographic light-sensitive materials of the present invention contain the compounds shown in the formulas: (I), (II), (III), or (IV). These compounds will now be described in detail.

In the formula (I), Y represents —N($R_1$)—$SO_2$—, —N($R_2$)—$SO_2$—N($R_3$)— or —N($R_4$)—CO—N($R_5$)—. R is a straight or branched alkyl group of 1–10 carbon atoms (for example, a methyl group, an ethyl group, a propyl group; an isopropyl group, a butyl group, a t-butyl group, a pentyl group, a hexyl group, and others), a straight or branched alkenyl group of 2–10 carbon atoms, (for example, a vinyl group, a propenyl group, a 1-methylvinyl group), a cycloalkyl group of 3–10 carbon atoms (for example, a cyclopropyl group, a cyclopentyl group, a cyclohexyl group, a 4-methylcyclohexyl group, and others),an aryl group of 6–12 carbon atoms (for example, a phenyl group, a 4-methylphenyl group and others), or an alalkyl group of 6–12 carbon atoms (for example, a benzyl group and others) are preferably used.

X represents —O—, —S—, or —N($R_6$)—.

For M, the following can be suitably cited: a hydrogen atom, an alkaline metal atom (for example, sodium, potassium, and the like), an ammonium group (for example, a trimethylammonium chloride group, a dimethylbenzylammonium chloride group and the like), or a group which cleaves and releases hydrogen or alkaline metals when in an alkaline environment (for example, an acetyl group, a cyanoethyl group, a methanesulfonylethyl group, and the like).

R' represents a hydrogen atom or a group capable of substituting with a hydrogen atom.

As examples of a group which can substitute for a hydrogen atom, the following can be suitably cited: a halogen atom (for example, a fluorine atom, a chlorine atom, a bromine atom and the like), a substituted or unsubstituted alkyl group of 1–6 carbon atoms (for example a methyl group, a trifluoromethyl group, an ethyl group, an n-butyl group, and the like), a substituted or unsubstituted aryl group of 6–12 carbon atoms (for example, a phenyl group, a 4-methylphenyl group and the like), a substituted or unsubstituted alkoxy group of 1–6 carbon atoms (for example, a methoxy group, an ethoxy group and the like), a substituted or unsubstituted aryloxy group of 6–12 carbon atoms (for example, a phenoxy group, a 4-methylphenoxy group and the like), a 1–12 carbon sulfonyl group (for example, a methane sulfonyl group, a p-toluene sulfonyl group and the like) a 1–12 carbon sulfamoyl group (for example, a diethylsulfamoyl group, a phenylsulfamoyl group and the like), a carbamoyl group of 1–12 carbons (for example, an unsubstituted carbamoyl group, a methylcarbamoyl group, a phenylcarbamoyl group and the like), an amide group of 2–12 carbons (for example, an acetoamide group, a benzamide group and the like), an ureide group of 1–12 carbons (for example, an unsubstituted ureide group, a 3-methylureide group, a 3-phenylureide group and the like), an aryl or alkoxy carbonyl group of 2–12 carbons (for example, a methoxycarbonyl group, a phenoxycarbonyl group and the like), an aryl or alkoxy carbonylamino group (for example, a methoxycarbonylamino group, a phenoxycarbonylamino group and the like), and a cyano group.

$R_1$–$R_6$ represent hydrogen atoms or an alkyl group of 1–6 carbons (for example, a methyl group, an ethyl group, a propyl group, a hexyl group, and the like), any of which can be suitably cited. The letter n represents 0, 1 or 2, and m represents 4-n.

In the formula (II), n' represents an integer of 1–4; $R_7$ and/or $R_8$ may be a branched or straight chained alkyl group, whether the alkyl group is substituted or unsubstituted. Such suitable examples of the alkyl group as a butyl group, isobutyl group, cyclohexyl group, heptyl group, octyl group, a dodecyl group and the like may be cited. The following suitable examples of a substituent of substituted alkyl groups may be given: an alkoxy group (for example, a methoxy group and the like) an aryloxy group, an acyloxy group, a heterocyclicoxy group, a hydroxy group, a carboxyl group or its salt, a formyl group, an acyl group, a substituted or unsubstituted carbamoyl group, an alkoxycarbonyl group, an aryloxycarbonyl group, a mercapto group, an alkylthio group, an arylthio group, a sulfino group or its salt, a sulfo group or its salt, an alkyl sulfinyl group, alkylsulfonyl group, an arylsulfonyl group, a substituted or unsubstituted sulfamoyl group, an alkoxysulfonyl group, an aryloxysulfonyl group, an acylamino group, a substituted or unsubstituted ureide group, an alkoxycarbonylamino group, an aryloxycarbonylamino group, a nitro group, a nitroso group, a cyano group, a halogen atom, an alkylsulfonylamino group, an arylsulfonylamino group, a substituted or unsubstituted sulfamoylamino group, a substituted or unsubstituted amino group, a cycloalkyl group, an alkenyl group, an aryl group, an aralkyl group, a heterocyclic group, or an alkynyl group, (for example, an ethynyl group and the like). $R_7$ and/or $R_8$ may be a substituted alkyl group possessing more than two substituents.

Suitable examples of substituted or unsubstituted cycloalkyl groups for $R_7$ and/or $R_8$ like a cyclopentyl group, a cyclohexyl group, a decahydronaphthyl group and such, can be cited.

For suitable examples of substituted or unsubstituted alkenyl groups for $R_7$ and/or $R_8$, the following can be given: a propenyl group, an isopropenyl group and a styryl group For suitable examples of substituted or unsubstituted alkynyl groups for $R_7$ and/or $R_8$, the following can be given: an ethynyl group and a phenylethynyl group.

As suitable examples of substituted and/or unsubstituted aralkyl groups for $R_7$ and/or $R_8$, the following can be given: a benzyl group, a phenethyl group, and the like.

As examples of substituted or unsubstituted aryl groups for $R_7$ and/or $R_8$, the following suitable examples can be given: a phenyl group, a naphthyl group and the like.

Suitable examples of substituents when $R_7$ and/or $R_8$ represent substituted aryl groups can be cited from the following: an alkyl group (for example, a methyl group, a dodecyl group and the like), an alkenyl group, an aryl group, a cycloalkyl group, an aralkyl group, an alkynyl group, a cyano group, a nitro group, a nitroso group, a substituted or unsubstituted amino group, an acylamino group, an alkylsulfonylamino group, an arylsulfonylamino group, a substituted or unsubstituted sulfamoylamino group, a hydroxy group, an alkoxy group, an aryloxy group, an alkoxycarbonyl group, an aryloxycarbonyl group, a heterocyclicoxy group, an acyloxy group, a heterocyclic group (a 5–6 membered ring, preferably a heterocyclic ring including a nitrogen group), an alkoxysulfonyl group, an aryloxysulfonyl group, an alkylsulfinyl group, an arylsulfinyl group, an alkylthio group, an arylthio group, a mercapto group, a formyl group, an acyl group, an alkylsulfonyl group, an arylsulfonyl group, a carboxylic acid group or its salt, a sulfonic acid or its salt, a sulfino group or its salt, a halogen atom (for example, fluorine, bromine, chlorine, iodine, and the like), a substituted or unsubstituted ureide group, a carbamoyl group, a sulfamoyl group, and the like. These substituents may have a further substituent, $R_7$ and/or $R_8$ may be substituted aryl groups with more than two substituents.

When $R_7$ and/or $R_8$ represent substituted or unsubstituted heterocyclic groups, 5 membered, or 6 membered rings are preferable. For example, a furyl group or a thienyl group, a benzothienyl group, a pyridyl group, a guinolyl group, and the like can be cited.

These heterocyclic rings may have the same substituents as those seen in the substituted aryl groups.

When $R_8$ is substituted or unsubstituted aryloxycarbonyl groups, a phonoxycarbonyl group and the like can be cited as a suitable example.

When $R_8$ represents a substituted or an unsubstituted alkoxycarbonyl group, suitable examples such as a methoxycarbonyl group, an ethoxycarbonyl group and the like can be cited.

When $R_8$ represents a substituted or unsubstituted carbamoyl group, apart from —$CONH_2$, substituted carbamoyl groups with the above substituted or unsubstituted alkyl, aryl or heterocyclic ring substitutent can be given as suitable examples. When n' represents 2, 3 or 4, $R_8$ represents for each, a divalent, trivalent, and a tetravalent residue, a suitable example of which would be a group which removes 1, 2, or 3 hydrogen atom monovalent group. When n' is 2, $R_8$ can also include —NH—.

L represents a single bond or divalent bond connecting group (preferably —O—OCO—$C_6H_4$—, or —CONH—$C_6H_4$—). The value of n' is preferably 1 or 2. Of these, it is preferable that $R_8$ represents a hydrogen atom. More preferable is the situation in which n' is 1 and $R_8$ represents a hydrogen atom and L represents —CONH—$C_6H_4$— and $R_7$ represents an alkyl group.

In general formula (IV), T and U represent —C($R_9$)—, or —N═.

The following can be suitably cited as examples of $R_9$: a hydrogen atom, a halogen atom, (for example, a chlorine atom, a bromine atom and such), a hydroxy group, a nito group, an alkyl group of 1–6 carbons (for example, a methyl group, an ethyl group, a methoxyethyl group, an n-butyl group, a 2-ethylhexyl group and the like), an alkenyl group of 2–6 carbons (for example, an allyl group and the like), an aralkyl group of 7–12 carbon atoms (for example, a benzyl group, a 4-methoxybenzyl group, and the like), an aryl group of 6–12 carbons (for example, a phenyl group, a naphthyl group, a 4-methanesulfonamidophenyl group, a 4-methylphenyl group, and the like), a carboxylic acid amido group of 1–12 carbon atoms (for example, an acetylamino group, a benzoylamino group, a methoxypropionylamino group), a sulfonamide group of 1–12 carbon atoms, (for example, a methanesulfonamide group, a benzenesulfonamide group, a p-toluenesulfonamide group and the like), an ureide group of 1–12 carbon atoms (for example, an unsubstituted ureide group, a methylureide group, a phenylureide group, and the like), or a thioureide group of 1–12 carbon atoms (for example, an unsubstituted thioureide group, a methylthioureide group, a methoxyethylthioureide group, a phenylthioureide group, and the like).

As for Z, the following can be suitably cited: a straight or branched alkylene group of 1–6 carbon atoms, (for example, a methylene group, an ethylene group, a propylene group, a butylene group, a hexylene group, a 1-methylethelene group, and the like), a straight or branched chain alkenylen group of 1–6 carbon atoms, (for example, a vinylene group, a 1-methylvinylene group, and the like), a straight or branched chain aralkylene group of 7–12 carbon atoms, (for example, a benzylidene group, and the like), or an arylene of 6–12 carbon atoms (for example, a phenylene group and the like).

s represents 0 or 1.

Y, R and M represent the same as they do in the formula (I), respectively.

The compounds outlined in the formulas (I), (II), (III), or (IV), will now be demonstrated through examples. However, the present invention is in no way limited by these examples. A detailed account of the formula (II) is given in Japanese Patent Application Laid-Open (JP-A) No. 3-238453.

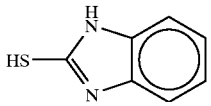
(A-1)

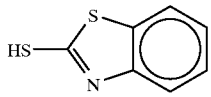
(A-2)

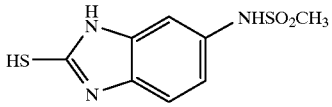
(A-3)

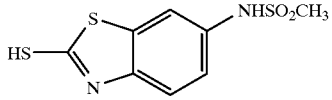
(A-4)

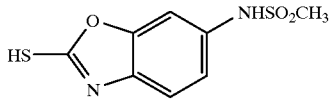
(A-5)

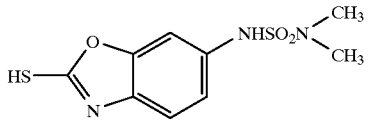
(A-6)

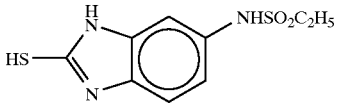
(A-7)

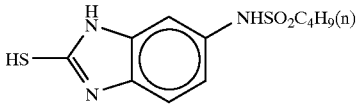
(A-8)

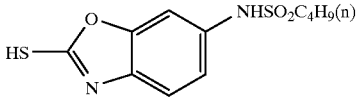
(A-9)

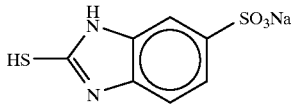
(A-10)

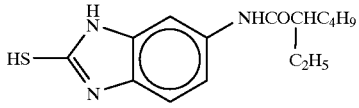
(A-11)

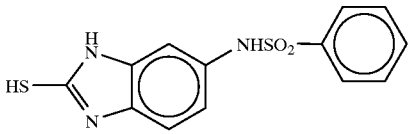
(A-12)

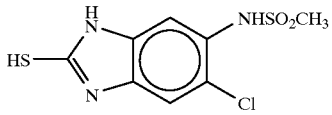
(A-13)

-continued (A-14)

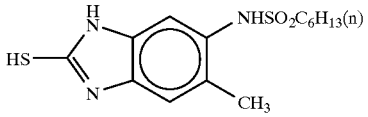

(A-15)

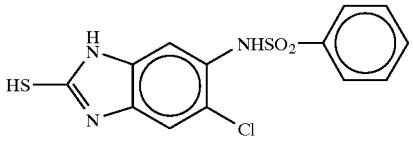

(A-16)

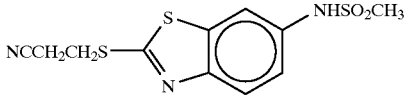

(A-17)

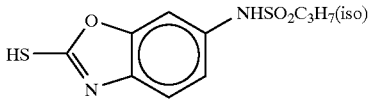

(A-18)

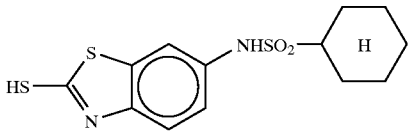

(A-19)

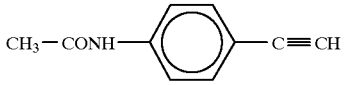

(A-20)

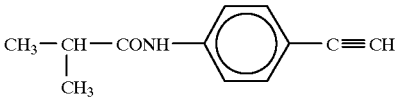

(A-21)

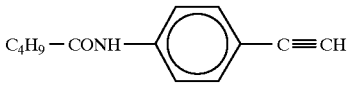

(A-22)

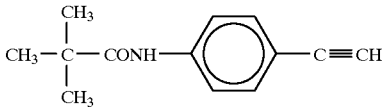

(A-23)

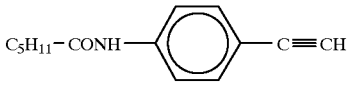

(A-24)

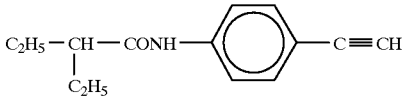

(A-25)

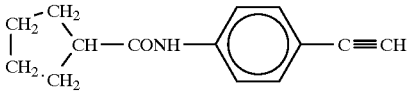

(A-26)

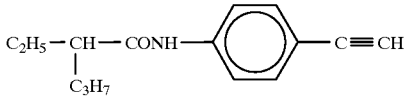

(A-27)

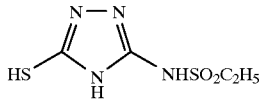

-continued (A-28)

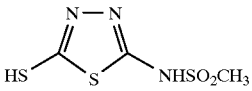

(A-29)

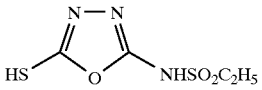

(A-30)

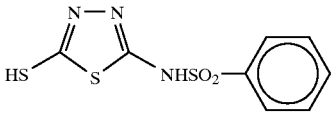

(A-31)

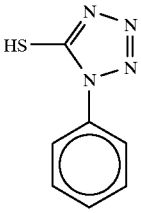

(A-32)

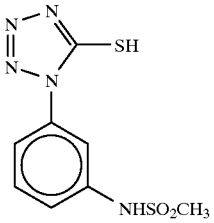

(A-33)

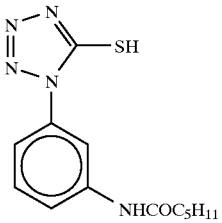

(A-34)

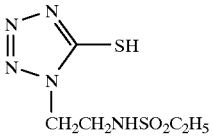

(A-35)

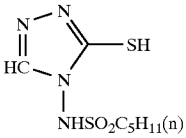

(A-36)

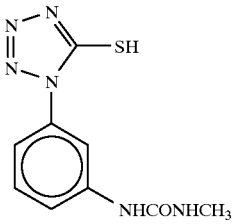

The heat developable silver halide color photographic light-sensitive materials of the present invention can make use of just one, or a combination of two or more of the compounds shown in any of the formulas (I)–(IV).

The layer in which a compound from any of the formulas (I)–(IV) is added can be any of the photographic constituent layers of the heat developable silver halide color photographic light-sensitive compounds, but a light-sensitive layer or a neighboring layer are preferable. The amount of compound from the formulas (I)–(IV) added is preferably $10^{-7}$ to $10^{-1}$ moles for every mole of light-sensitive silver halide present, more preferably $10^{-5}$ to $10^{-2}$ moles.

The compounds from the formulas (I)–(IV) can be added preferably at any stage from during the preparation of the photographic emulsion, after its preparation, up to just before coating. Usually it is preferable to add the compounds at any of the processes after its preparation up to just before the coating.

It is possible, in the present invention, for the processing materials which are plied with the heat developable silver halide color photographic light-sensitive materials at the time of processing to contain the compounds shown in formulas (I)–(IV). In the same way as with the heat developable silver halide color photographic light-sensitive materials, the processing materials may contain one, or a combination of the compounds from formulas (I)–(IV).

When adding the compounds from the formulas (I)–(IV) to the processing materials, it is preferable to add the said compounds as close as possible to the topmost layer of the processing materials in order to produce anti-fogging effects by promoting the diffusion of these compounds into the heat developable silver halide color photographic light-sensitive materials from the processing materials.

The amount of compounds from the formulas (I)–(IV) to be added to the processing materials is preferably $10^{-6}$ to $10^{-1}$ moles per mole of silver halide in the heat developable silver halide color photographic light-sensitive materials at the time of plying with the processing material. A value of $10^{-4}$ to $10^{-1}$ is more preferable.

When constructing silver halide color photographic light-sensitive material in the present invention, in order to reproduce the original scene, basically, the subtractive color process principle can be used to recreate colors.

In other words, with color negative film comprising at least 3 types of light-sensitive layers possessing respective light-sensitivity to the blue, green, or red regions, and possessing color couplers capable of forming yellow, magenta, or cyano dye with a complementary color relationship to those light-sensitive regions, the color information of the original scene can be recorded. The original scene can then be reproduced by exposing color photographic paper, possessing the same light-sensitive wavelength-coloration relationship as the color negative film, through the color image produced in the above manner. Also, through the use of scanners and the like, the color image information of the original scene can be computer-read and images based on this information can be reproduced for pleasure.

It is also possible to provide three or more light-sensitive layers possessing light-sensitivity to different regions of the spectrum in the silver halide color photographic light-sensitive material of the present invention.

The light-sensitive wavelength region and hue of layer may be related other than in just the complementary color relation. In such a case, it is possible for the original scene to be reproduced by hue conversion of the image information taken in.

Preferably the silver halide color photographic light-sensitive material of the present invention contains at least two types of light-sensitive silver halide emulsions having light-sensitivity in the same region of the spectrum, but different average grain projected areas. In the present invention, "light-sensitivity in the same region of the spectrum" means light-sensitivity in substantially the same region of the spectrum. So, if the regions of light-sensitivity are slightly separate, but largely overlapping, the emulsions can be considered to be light-sensitive in the same region of the spectrum.

In the present invention, light-sensitive silver halide emulsions with light-sensitivity in the same region of the spectrum but having different average grain projected areas may be distributed in separate light-sensitive layers, or in one light-sensitive layer.

When these light-sensitive silver halide emulsions are distributed in separate light-sensitive layers, it is preferable that the color couplers used to combine with the emulsions all have the same hue. However, a color coupler which is incorporated in one of the light-sensitive layers may be different from a color coupler which is incorporated in another layer so that the light-sensitive layers produce different colors, or otherwise the light-sensitive layers may have couplers leading to different absorption profiles of hue.

For examples of light-sensitive silver halide emulsions used in the present invention, any of those prepared by the following can be selected: U.S. Pat. No. 4,500,626, column 50, U.S. Pat. No. 4,628,021, Research Disclosure (RD) No. 17,029, (1978), RD No. 17,643 (December 1978), pp.22–23, RD No. 18,716 (November 1979), pp.648, RD No. 307,105 (November 1989), PP. 863–865, Japanese Patent Application Laid Open (JP-A) Nos. 62-253,159, 64-13,546, 2-236, 546 and 3-110,555, P. Glafkides, Chimie et Physique Photographique, Paul Montel, 1967, G. F. Duffin, photographic Emulsion Chemistry, Focal Press, 1966, and V. L. Zelikman et al., Making and Coating Photographic Emulsions, Focal Press, 1964.

In the process for preparing the light-sensitive silver halide emulsion of the present invention, it is preferable that a salt removing process be conducted in order to remove excessive salt. For the removal of salt, employable methods include a Noodle water-washing method in which a salt is removed by the gelation of gelatin and a floculation method which utilizes such material as an inorganic salt comprising a polyvalent anion (e.g., sodium sulfate), an anionic surfactant, an anionic polymer (e.g., polystyrene sulfonic acid sodium salt) or a gelatin derivative (e.g., aliphatic-acylated gelatin, aromatic-acylated gelatin and aromatic-carbamoylated gelatin). Among these, a floculation method is preferably used.

For a variety of purposes, the light-sensitive silver halide emulsion in the present invention may contain a heavy metal such as iridium, rhodium, platinum, cadmium, zinc, thallium, lead, iron and osmium. These heavy metals may be used alone or in a combination of two or more of them. Although the amount added of such compounds is selected depending on the purpose of use, this amount is generally in the range of $10^{-9}$ to $10^{-3}$ mol based on 1 mol of silver halide. The heavy metal may be present uniformly in a silver halide grain or may be present in a localized manner within or on the surface of a silver halide grain. Preferred examples of these emulsions are the emulsions described in Japanese Patent Application Laid-Open (JP-A) Nos. 2-236,542, 1-116,637 and 5-181,246.

Such compound as a rhodanate, ammonia, a tetra-substituted thiourea compound, an organic thioether derivative described in Japanese Patent Application Publication (JP-B) No. 47-11,386 and a sulfur-containing compound described in Japanese Patent Application Laid-Open (JP-A) No. 53-144,319 may be used as a solvent for silver halide in the grain forming stage for the light-sensitive silver halide emulsion used in the present invention.

For other conditions for the silver halide grain formation, reference will be made, for example, to P. Glafkides, Chimie et Physique Photographique, Paul Montel, 1967, G. F. Duffin, Photographic Emulsion Chemistry, Focal Press , 1966, V. L. Zelikman et al., Making and Coating Photographic Emulsion, Focal Press, 1964, and the like. That is, an employable method may be selected from an acidic method, a neutral method and an ammonia method. Further, any method selected from a single jet method, a double jet method and a combination thereof may be used as a method for reacting a soluble silver salt with a soluble halides. A double jet method is preferable for obtaining a monodisperse emulsion.

An reversed mixing method in which light-sensitive silver halide emulsion grains are formed in the presence of an excess of silver ion can also be employed. A so-called controlled double jet method in which pAg of the liquid phase for the formation of silver halide is kept constant can also be employed as a double jet method.

Meanwhile, the concentrations, amounts to be added and adding rates of the silver salt and halogen salt may be increased in order to accelerate the growth of the light-sensitive silver halide emulsion grains (Japanese Patent Application Laid-Open (JP-A) Nos. 55-142,329 and 55-158,124 and U.S. Pat. No. 3,650,757).

The stirring of the reaction mixture may be effected by any known method. Further, the temperature and pH of the reaction mixture during the formation of light-sensitive silver halide grains may be selected depending on the purpose. The pH is preferably in the range of 2.2 to 7.0, and more preferably 2.5 to 6.0.

A light-sensitive silver halide emulsion is normally a chemically sensitized silver halide emulsion. A sensitizing method by means of chalcogen, such as sulfur sensitization, selenium sensitization or tellurium sensitization, a sensitizing method by means of a rare metal, such as gold, platinum or palladium, and a sensitizing method by means of reduction, which are known sensitizing methods in the preparation of conventional light-sensitive emulsions, may be used alone or in combination thereof as a chemical sensitizing method of the light-sensitive silver halide emulsion used in the present invention (see, for example, Japanese Patent Application Laid-Open (JP-A) Nos. 3-110,555 and 5-241,267). A chemical sensitization according to any of the above-mentioned methods can be effected in the presence of a nitrogen-containing heterocyclic compound (Japanese Patent Application Laid-Open (JP-A) No. 62-253,159). Besides, an anti-fogging agent, which is described later, may be added to a silver halide emulsion after the chemical sensitization thereof. More concretely, the methods, which are described in Japanese Patent Application Laid-Open (JP-A) Nos. 5-45,833 and 62-40,446, can be used.

When a chemical sensitization is carried out, pH is preferably in the range of 5.3 to 10.5, and more preferably 5.5 to 8.5, while pAg is preferably in the range of 6.0 to 10.5, and more preferably 6.8 to 9.0.

The coated weight of the light-sensitive silver halide to be used in the present invention is preferably in the range of 1 mg to 10 g/m$^2$, more preferably 0.1 mg to 10 g/m$^2$, and most preferably 1 mg to 5 g/m$^2$, based on the weight of silver.

In order to impart color-sensitivity, such as green-sensitivity or red-sensitivity, to the light-sensitive silver halide, the light-sensitive silver halide emulsion is spectrally sensitized by means of a methine dye or the like. Further, if necessary, a blue-sensitive emulsion may be spectrally sensitized in order to enhance sensitivity to the light of the blue color region.

Examples of employable dyes include cyanine dyes, merocyanine dyes, complex cyanine dyes, complex merocyanine dyes, holopolar cyanine dyes, hemicyanine dyes, styryl dyes and hemioxonol dyes.

More concrete examples of these sensitizing dyes are disclosed, for example, in U.S. Pat. No. 4,617,257 and Japanese Patent Application Laid-Open (JP-A) Nos. 59-180,550, 64-13,546, 5-45,828 and 5-45,834.

Although these sensitizing dyes may be used alone, they may also be used in a combination thereof. A combination of these sensitizing dyes is often used particularly for supersensitization or for wavelength adjustment of spectral sensitization.

The emulsion used in the present invention may contain a compound which is a dye having no spectral sensitization effect itself or a compound substantially incapable of absorbing a visible light but which exhibits a supersensitizing effect (e.g., compounds described in U.S. Pat. No. 3,615,641 and Japanese Patent Application Laid-Open (JP-A) No. 63-23,145).

The above-mentioned sensitizing dye can be added to the light-sensitive silver halide emulsion at the stage of chemical aging or thereabout, or before or after the formation of the nucleus of the silver halide grains in accordance with the descriptions in U.S. Pat. Nos. 4,183,756 and 4,225,666. These sensitizing dyes or supersensitizers may be added to the emulsion as a solution in an organic solvent, such as methanol, a dispersion in gelatin or solution containing a surfactant. The amount of these sensitizing agent and supersensitizer to be added is generally in the range of $10^{-8}$ to $10^{-2}$ mol based on 1 mol of silver halide.

Known photographic additives, which are used in the above-described processes and in the present invention, are described in the aforementioned RD No. 17,643, RD No. 18,716 and RD No. 307,105, the relationship in the description is shown below.

| Kinds of additives | RD17, 643 | RD18, 716 | RD307, 105 |
|---|---|---|---|
| 1. Chemical sensitizer | pp. 23 | pp. 648, RC | pp. 866 |
| 2. Sensitivity enhancer | | pp. 648, RC | |
| 3. Spectral sensitizer/ Supersensitizer | pp. 23–24 | pp. 648, RC ~pp. 649, RC | pp. 866–868 |
| 4. Brightening agent | pp. 24 | pp. 648, RC | pp. 868 |
| 5. Light absorber/ Filter/Dye/ Ultraviolet ray absorber | pp. 25–26 | pp. 649, RC ~pp. 650, LC | pp. 873 |
| 6. Dye image stabilizer | pp. 25 | pp. 650, LC | pp. 872 |
| 7. Film hardener | pp. 26 | pp. 651, LC | pp. 874–875 |
| 8. Binder | pp. 26 | pp. 651, LC | pp. 873–874 |
| 9. Plasticizer/ Lubricant | pp. 27 | pp. 650, RC | pp. 876 |
| 10. Coating aid/ Surfactant | pp. 26–27 | pp. 650, RC | pp. 875–876 |
| 11. Anti-static agent | pp. 27 | pp. 650, RC | pp. 876–877 |
| 12. Matting agent | | | pp. 878–879 |

(RC: right column,
LC: left column)

An organic metal salt may be used as an oxidant together with a light-sensitive silver halide emulsion in the present invention. Among these organic metal salts, an organic silver salt is particularly preferable.

Examples of the organic compounds which can be used for the preparation of the above-mentioned organic silver salts serving as an oxidant include benzotriazoles, fatty acids and other compounds described in U.S. Pat. No. 4,500,626, columns 52–53. The silver acetylide, which is described in U.S. Pat. No. 4,775,613, is also useful. These silver salts may be used alone or in a combination of two or more of them.

The above-mentioned organic silver salt can be used in an amount in the range of 0.01 to 10 mol, and preferably 0.01 to 1 mol, based on 1 mol of the light-sensitive silver halide. The total coated weight of the light-sensitive silver halide and the organic silver salt is in the range of 0.05 to 10 g/m$^2$, and preferably 0.1 to 4 g/m$^2$, based on the weight of silver.

The binder for a photographic constituent layer of the heat developable silver halide color photographic light-sensitive material is preferably a hydrophilic material, examples of which include those described in the aforesaid Research Disclosure and in Japanese Patent Application Laid-Open (JP-A) No. 64-13,546, pp. 71–75. More specifically, the binder is preferably a transparent or translucent hydrophilic material, exemplified by a naturally occurring compound, such as a protein including gelatin and a gelatin derivative; and a polysaccharide including a cellulose derivative, starch, gum arabic, dextran and pullulane, and by a synthetic polymer such as polyvinyl alcohol, polyvinyl pyrrolidone and acryl amide polymer. Also usable as the binder is a highly water-absorbent polymer described in U.S. Pat. No. 4,960,681 and Japanese Patent Application Laid-Open (JP-A) No. 62-245,260, for example, a homopolymer composed of a vinyl monomer having —COOM or —$SO_3$M (M stands for a hydrogen atom or an alkali metal), or a copolymer obtained by a combination of these monomers or obtained by a combination of at least one of these monomers and another monomer(s) such as sodium methacrylate, ammonium methacrylate and SUMIKAGEL L-5H manufactured by Sumitomo Chemical Co., Ltd. These binders may be used alone or in a combination of two or more of them. Particularly, a combination of gelatin and any of the above-mentioned non-gelatin binders is preferable. Depending on purposes, a lime-processed gelatin, acid-processed gelatin and delimed gelatin which has undergone a deliming process to decrease the content of calcium and the like can be used. Alternatively, a combination of these processed gelatin substances may be employed.

In the present invention, the coated weight of the binder is preferably to 1 to 20 g/m$^2$ or less, and more preferably to 2 to 10 g/m$^2$ or less.

The coupler to be used in the present invention may be a 4-equivalent coupler or a 2-equivalent coupler. In these couplers, the nondiffusive group may form a polymeric chain. Details of the coupler are described, for example, in T. H. James, The Theory of the Photographic Process, 4th edition, pp. 291–334, pp. 354–361, and in Japanese Patent Application Laid-Open (JP-A) Nos. 58-123,533, 58-149,046, 58-149,047, 59-111,148, 59-124,399, 59-174,835, 59-231,539, 59-231,540, 60-2,950, 60-2,951, 60-14,242, 60-23,474, 60-66,249, 8-110,608, 8-146,552 and 8-146,578.

Further, the following couplers are preferably used in the present invention.

Yellow couplers: couplers represented by the formulas (I) and (II) in EP 502,242A; couplers represented by the formulas (1) and (2) in EP 513,496A; couplers represented by the general formula (I) described in claim 1 of Japanese Patent Application Laid-Open (JP-A) No. 5-307,248; couplers represented by the general formula (D) in U.S. Pat. No. 5,066,576, column 1, lines 45 to 55; couplers represented by the general formula (D) in Japanese Patent Application Laid-Open (JP-A) No. 4-274,425, paragraph 008; couplers described in EP 498,381A1, claim 1 on page 40; couplers represented by the formula (Y) in EP 447,969A1, pp. 4; and couplers represented by the general formulas (I) to (IV) in U.S. Pat. No. 4,476,219, column 7, lines 36 to 58.

Magenta couplers: couplers described in Japanese Patent Application Laid-Open (JP-A) Nos. 3-39,737, 6-43,611, 5-204,106 and 4-3,626.

Cyan couplers: couplers described in Japanese Patent Application Laid-Open (JP-A) Nos. 4-204,843, 4-43,345 6-347,960, 5-313,324 and 5-313,325.

Polymeric couplers: couplers described in Japanese Patent Application Laid-Open (JP-A) No. 2-44,345.

The couplers described in U.S. Pat. No. 4,366,237, GB 2,125,570, EP 96,570 and DE 3,234,533 are preferable as a coupler which generates a dye having an appropriate diffusive property.

The heat developable silver halide color photographic light-sensitive material in the present invention may contain a functional coupler, for example, a coupler which is designed to correct the unnecessary absorption of a coloring dye, such as the yellow colored cyan coupler and the yellow colored magenta coupler described in EP 456,257A1, the magenta colored cyan coupler described in U.S. Pat. No. 4,833,069 and the masking coupler represented by the formula (2) in U.S. Pat. No. 4,837,136 and by the formula (A) in claim 1 of WO 92/11,575 (compounds shown at pages 36–45 in particular).

In the present invention, it is preferable to use a coupler or other compound which reacts with the oxidation product of a developing agent to release a photographically important compound.

Examples of the compounds (including couplers) which react with the oxidation product of a developing agent to release photographically important compound residues, include a compound which releases a development inhibitor such as compounds represented by the formulas (I) to (IV) described on page 11 in EP 378,236A1, compounds represented by the formula (I) described on page 7 in EP 436,938A2, compounds represented by the formula (1) described in Japanese Patent Application Laid-Open (JP-A) No. 5-307,248, compounds represented by the formulas (I) to (III) described on pages 5 and 6 in EP 440,195A2, compound-ligand releasing compounds represented by the formula (I) described in claim 1 of Japanese Patent Application Laid-Open (JP-A) No. 6-59,411 and compounds represented by LIG-X described in claim 1 of U.S. Pat. No. 4,555,478.

In the present invention, the amount of the coupler added is preferably from 1/1000 to 1 mol, and more preferably from 1/500 to 1/5 mol based on 1 mol of silver halide.

The heat developable silver halide color photographic light-sensitive material of the present invention should contain a developing agent, the oxidation product of which results from the silver development and is capable of coupling with the aforementioned coupler to form a dye.

Examples of such a combination of a coupler and a developing agent include a combination of p-phenylene diamines as a developing agent and a phenol or active methylene coupler described in U.S. Pat. No. 3,531,256 and a combination of p-aminophenols as a developing agent and an active methylene coupler described in U.S. Pat. No. 3,761,270.

Further, a sulfonamide phenol described in U.S. Pat. No. 4,021,240 and Japanese Patent Application Laid-Open (JP-A) No. 60-128,438, is preferable, because this combination assures an excellent storage stability of the raw heat developable silver halide color photographic light-sensitive material.

In the present invention, a precursor of a developing agent may be used, examples of which include an indoaniline compound described in U.S. Pat. No. 3,342,597, a Schiff base-type compound described in U.S. Pat. No. 3,342,599 and in Research Disclosure Nos. 14,850 and 15,159, an aldol compound described in Research Disclosure No. 13,924, a metal salt complex described in U.S. Pat. No. 3,719,492 and a urethane compound described in Japanese Patent Application Laid-Open (JP-A) No. 53-135,628.

Other combinations, i.e., a combination of a sulfonamide phenol developing agent and a coupler as described in Japanese Patent Application Laid-Open (JP-A) No. 9-15,806 and a combination of a hydrazine developing agent and a coupler as described in Japanese Patent Application Laid-Open (JP-A) Nos. 8-286,340 and 8-234,388, are also preferable for use in the heat developable silver halide color photographic light-sensitive material of the present invention.

Examples of the sulfonamide phenol developing agent include the following compound.

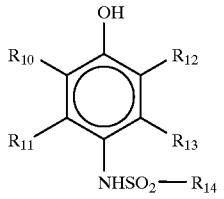

Examples of the hydrazine developing agent include the following compound.

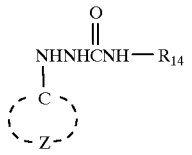

In these formulas, $R_{10}$–$R_{13}$ represent any of the following: a hydrogen atom, a halogen atom, an alkyl group, an aryl group, an alkylcarboxylic acid amide group, an arylcarboxylic acid amide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfmoyl group, an arylsulfamoyl group, a sulfamoyl group, a ciano group, an alkylsulfonyl group, an arylsulfonyl group, an alkoxycarbonyl group, an aryloxycarbonyl group, an alkylcarbonyl group, an arylcarbonyl group, or acyloxy group. $R_{14}$ represents an alkyl group, an aryl group or a heterocyclic group, Z represents a group of atoms forming an (heterocyclic) aromatic ring. When Z is a benzene ring, the substituent has a Hammett constant (σ) total value of at least 1. Each of these compounds should possess at least one ballast group of at least 8 carbon atoms to afford oil solubility to molecules.

In the case where a nondiffusive developing agent is used, if necessary, an electron transport agent and/or a precursor thereof can be used in the light-sensitive material of the present invention in order to accelerate the transportation of electron between the nondiffusive developing agent and the silver halide which is to be developed. Use of electron transport agents and precursors thereof, which are described in U.S. Pat. No. 5,139,919 and in European Patent Application Laid-Open No. 418,743, is particularly preferred in the present invention use of methods for introducing the electron transport agent and/or precursor thereof into a layer in a stable manner, which are described in Japanese Patent Application Laid-Open (JP-A) Nos. 2-230,143 and 2-235,044, is particularly preferred in the present invention.

An electron transport agent or a precursor thereof can be selected from the aforesaid developing agents or precursors thereof. The mobility of the electron transport agent or a precursor thereof is preferably greater than that of a nondiffusive developing agent (electron donor). A particularly useful electron transport agents are 1-phenyl-3-pyrazolidones or aminophenols.

A precursor of electron donor, which is described in Japanese Patent Application Laid-Open (JP-A) No. 3-160,443, is also preferable for use in the light-sensitive material of the present invention.

For such purposes as prevention of color mixing, improvement in the color reproduction and the like, a reducing agent may be used in an intermediate layer or in a protective layer. The reducing agents, which are described in European Patent Application Laid-Open Nos. 524,649 and 357,040 and in Japanese Patent Application Laid-Open (JP-A) Nos. 4-249,245, 2-46,450 and 63-186,240, are particularly preferable for use in the present invention. Also usable are development inhibitor releasing reducers which are described in Japanese Patent Application Publication (JP-B) No. 3-63,733, Japanese Patent Application Laid-Open (JP-A) Nos. 1-150,135, 2-46,450, 2-64,634, and 3-43,735 and European Patent Application Laid-Open No. 451,833.

Further, a precursor of a developing agent, which does not have reducing properties per se but which exhibits reducing properties under the influence of a nucleophilic reagent or heat in the process of development, can be used in the light-sensitive material of the present invention.

The heat developable silver halide color photographic light-sensitive material of the present invention can contain any of the following reducing agents, examples of which are the reducing agents and precursors thereof described in U.S. Pat. Nos. 4,500,626, columns 49–50, 4,839,272, 4,330,617, 4,590,152, 5,017,454 and 5,139,919, Japanese Patent Application Laid-Open (JP-A) Nos. 60-140,335, pp. 17–18, 57-40,245, 56-138,736, 59-178,458, 59-53,831, 59-182,449, 59-182,450, 60-119,555, 60-128,436, 60-128,439, 60-198,540, 60-181,742, 61-259,253, 62-244,044, 62-131,253, 62-131,256, 64-13,546, pp. 40–57, and 1-120,553 and European Patent Application Laid-Open No. 220,746A2, pp. 78–96.

Further, a combination of reducing agents, which is disclosed in U.S. Pat. No. 3,039,869, can also be used in the present invention.

The developing agents or the reducing agents may be incorporated in a processing material, which is described later, although they may be incorporated in the heat developable silver halide color photographic light-sensitive material.

The total amount of the developing agent and the reducing agent to be employed in the present invention is in the range of 0.01 to 20 mol, preferably 0.01 to 10 mol, based on 1 mol of silver.

In the present invention, either a 4-equivalent coupler or a 2-equivalent coupler is selected for use depending on the kind of the developing agent.

Examples of the 4-equivalent couplers and 2-equivalent couplers are described in detail in "Theory of the Photographic Process" (4th edition by T. H. James, Macmillan, 1977), pp. 291–334, pp. 354–361, and in Japanese Patent Application Laid-Open (JP-A) Nos. 58-12,353, 58-149,046, 58-149,047, 59-11,114, 59-124,399, 59-174,835, 59-231, 539, 59-231,540, 60-2,951, 60-14,242, 60-23,474 and 60-66,249 in addition to the aforementioned literature and patents.

Hydrophobic additives, such as a coupler, a developing agent and a nondiffusive reducing agent, can be introduced into a layer of a heat developable silver halide color photographic light-sensitive material according to a known method such as the method described in U.S. Pat. No. 2,322,027. In this case, a high boiling point organic solvent, which is described in U.S. Pat. Nos. 4,555,470, 4,536,466, 4,536,467, 4,587,206, 4,555,476 and 5,599,296 and in Japanese Patent Application Publication (JP-B) No. 3-62,256, can be used, if necessary, together with an organic solvent having a lower boiling point in the range of 50 to 160° C. Besides these color forming compounds, nondiffusive reducing agents, high boiling point organic solvents and the like may be used in a combination of two or more of them, respectively.

The amount of the high boiling point organic solvent is 10 g or less, preferably 5 g or less, more preferably in the range of 0.1 to 1 g, based on 1 g of the hydrophobic additives to be used. The amount of the high boiling point organic solvent is preferably 1 cc or less, more preferably 0.5 cc or less, most preferably 0.3 cc or less, based on 1 g of the binder.

Examples of useful methods for introducing a hydrophobic additive into the layer of a light-sensitive material include a dispersion method utilizing a polymer as described in Japanese Patent Application Publication (JP-B) No. 51-39,853 and Japanese Patent Application Laid-Open (JP-A) No. 51-59,943 and a method wherein a hydrophobic additive, which has been converted into a dispersion of fine grains, is added to the layer as described in Japanese Patent Application Laid-Open (JP-A) No. 62-30,242.

In addition to the above methods, in the case where the hydrophobic additive is a compound substantially insoluble in water, the hydrophobic compound may be dispersed in a binder.

When dispersing a hydrophobic compound to form a hydrophilic colloidal dispersion, a variety of surfactants can be used. For example, surfactants, which are described in Japanese Patent Application Laid-Open (JP-A) No. 59-157, 636, pp. 37–38, and in aforesaid Research Disclosure, can be used. In addition, a phosphoric ester-type surfactant, which is described in Japanese Patent Application Laid-Open (JP-A) Nos. 7-56,267 and 7-228,589 and in German Patent Application Laid-Open No. 1,932,299A, can also be used in the light-sensitive material of the present invention.

The heat developable silver halide color photographic light-sensitive material of the present invention may contain a compound which activates the development and stabilizes the image. Preferred examples of these compounds are described in U.S. Pat. No. 4,500,626, columns 51–52.

A non-light-sensitive layer, such as a protective layer, a prime layer, an intermediate layer, a yellow filter layer and/or an antihalation layer, may be formed between the light-sensitive layers containing light-sensitive silver halide emulsion of the heat developable silver halide color photographic light-sensitive material and/or as a top layer and/or a bottom layer thereof. Further, a supplementary layer, such as a back layer, may be formed on the reverse side of the support opposite to the side on which the photographic light-sensitive layer is formed. In the present invention, photographic constituent layers include non-light-sensitive layers and light-sensitive layers. More specifically, it is possible to form, on the support, various layers including the above-mentioned construction, a prime layer described in U.S. Pat. No. 5,051,335, an intermediate layer containing a solid pigment described in Japanese Patent Application Laid-Open (JP-A) Nos. 1-167,838 and 61-20,943, an intermediate layer containing a reducing agent or a DIR compound described in Japanese Patent Application Laid-Open (JP-A) Nos. 1-120,553, 5-34,884 and 2-64,634, an intermediate layer containing an electron transport layer described in U.S. Pat. Nos. 5,017,454 and 5,139,919 and in Japanese Patent Application Laid-Open (JP-A) No. 2-235,044 and a protective layer containing a reducing agent described in Japanese Patent Application Laid-Open (JP-A) No. 4-249, 245 as well as a combination of two or more of these layers.

A dye, which can be used in a yellow filter layer or in an antihalation layer, is preferably a dye which loses its color or is eliminated at the time of development so that it exerts no influence on the density of image after the process.

That the dye which is present in the yellow filter layer or in the antihalation layer loses its color or is eliminated at the time of development means that the amount of the dye remaining after the process is less than one third, preferably less than one tenth, of the amount of the dye present before the process. This may be attained by a phenomenon wherein the component of the dye is leached out of the heat developable silver halide color photographic light-sensitive material or is transferred into the processing material at the time of development, or by a phenomenon wherein the component of the dye undergoes a reaction and becomes a colorless compound at the time of development.

A known dye can be used in the heat developable silver halide color photographic light-sensitive material of the present invention. For example, employable dyes include a dye, which is soluble in an alkaline solution of a developer, and a dye which becomes colorless as a result of the reaction with an ingredient of the developing solution, sulfite ion, a developing agent or an alkali.

Concrete examples of the dyes include the dye described in European Patent Application EP 549,489A and the dye described in Japanese Patent Application Laid-Open (JP-A) No. 7-152,129, ExF 2–6. A dye which is dispersed in fine solid grains and is described in Japanese Patent Application Laid-Open (JP-A) No. 8-101,487 can also be used. Although this dye can also be used in the case where the heat developable silver halide color photographic light-sensitive material is developed with a processing solution, this dye is particularly suitable to the case where the heat developable silver halide color photographic light-sensitive material is subjected to a heat development utilizing a processing material which is described later.

Further, it is also possible to fix a dye to a mordant and a binder. In this case, the mordant and the dye may be those well known in the field of photography. Examples of the mordants include those described in U.S. Pat. No. 4,500, 626, columns 58–59 and in Japanese Patent Application Laid-Open (JP-A) Nos. 61-88,256, pp. 32–41, 62-244,043 and 62-244,036.

Furthermore, it is also possible to use a reducing agent and a compound which reacts with the reducing agent to release a diffusive dye so that the alkali generated at the time of development causes the reaction to release a mobile dye, which will be eliminated either by being dissolved in the processing solution or by being transferred to the processing material. Examples of these compounds and reducing agents are described in U.S. Pat. Nos. 4,559,290 and 4,783,369, European Patent No. 220,746A2, JIII Journal of Technical Disclosure No. 87-6,119 and Japanese Patent Application Laid-Open (JP-A) No. 8-101,487, paragraph 0080–0081.

A leuco dye, which becomes colorless, can also be used in the light-sensitive material of the present invention. For example, Japanese Patent Application Laid-Open (JP-A) No. 1-150,132 discloses a silver halide light-sensitive material containing a leuco dye which is given a color in advance by means of a metal salt of an organic acid as a color developer. Since a complex of a leuco dye and a developer undergoes a reaction by heat or reacts with an alkali to become colorless, the use of the combination of a leuco dye and a color developer in the heat developable silver halide color photographic light-sensitive material of the present invention is desirable if the light-sensitive material of the present invention is to be subjected to a heat development.

In the present invention, a known leuco dye can be used, examples of which are described in Moriga and Yoshida, "Senryo to Yakuhin (Dyes and Chemicals)," vol. 9, pp. 84, Association of Chemical Products, "Shinban Senryo Binran (New Handbook of Dyes)", pp. 242, Maruzen Co., Ltd. (1970), R. Garner, "Reports on the Progress of Applied Chemistry," vol. 56, pp. 199 (1971), "Senryo to Yakuhin (Dyes and Chemicals)", vol. 19, pp. 230, Association of Chemical Products (1974), "Shinkizai (Color Materials),", vol. 62, pp. 288 (1989) and "Senryo Kogyo (Die Industry)," vol. 32, pp. 208.

Preferred color developers are a metal salt of an organic acid in addition to acid clay and a phenol/formaldehyde resin. Among metal salts of organic acids, metal salts of salicylic acids, a metal salt of a phenol/salicylic acid/formaldehyde resin, a rhodan salt and a metal salt of xanthogenic acid are preferable. Zinc is particularly preferable among the metals. An oil-soluble zinc salicylate described in U.S. Pat. Nos. 3,864,146 and 4,046,941 and in Japanese Patent Application Publication (JP-B) No. 52-1, 327 can be also used as the color developers.

The heat developable silver halide color photographic light-sensitive material of the present invention is preferably hardened by means of a hardener.

Examples of the hardener include those described in U.S. Pat. Nos. 4,678,739, column 41 and 4,791,042, and in Japanese Patent Application Laid-Open (JP-A) Nos. 59-116, 655, 62-245,261, 61-18,942 and 4-218,044. More specifically, examples of these hardeners include an aldehyde (e.g., formaldehyde), an aziridine, an epoxy, a vinylsulfone (e.g., N,N'-ethylene-bis(vinylsulfonylacetamide) ethane), a N-methylol compound (e.g., dimethylolurea), boric acid, metaboric acid and a polymeric compound (e.g., a compound described in Japanese Patent Application Laid-Open (JP-A) No. 62-234,157).

The amount of the hardener added is in the range of 0.001 g to 1 g, preferably 0.005 to 0.5 g, based on 1 g of the hydrophilic binder.

The heat developable silver halide color photographic light-sensitive material of the present invention will be exposed to light and thereafter developed by supplying water to the light-sensitive material and/or a processing material containing a base and/or a base precursor in an amount ranging from 1/10 to the equivalent of an amount which is required for the maximum swelling of the total of the coated layers of these materials, plying and heating them.

The present invention has been made in order to realized a superior level of granulation and exposure latitude in the above-described heat development, and in order to lessen the adverse environmental influences that accompany the development using a developing solution. The heat developable silver halide color photographic light-sensitive material of the present invention, however, may be developed by means of an activator method utilizing an alkaline processing solution or by means of a developing method utilizing a processing solution containing a developing agent and a base.

A thermal process of a heat developable silver halide color photographic light-sensitive material is well known in the art. For example, a heat developable light-sensitive material and a heat development process are described in "Syashinkogaku no kiso (Fundamentals of Photographic Engineering)", pp. 553–555, Corona Co., Ltd. (1970), "Eizojoho (Image Information)" (April, 1978), pp. 40, "Nablett's Handbook of Photography and Reprography", 7th Ed. (Vna Nostrand and Reinhold Company), pp. 32–pp. 33, U.S. Pat. Nos. 3,152,904, 3,301,678, 3,392,020 and 3,457,075, U. K. Pat. Nos. 1,131,108 and 1,167,777 and Research Disclosure (June, 1978), pp. 9–15 (RD-17,029).

An activator process means a developing process in which a heat developable silver halide color photographic light-sensitive material containing a developing agent is processed with a processing solution containing no developing agent. A feature of the activator process is that the processing solution for the process does not contain a developing agent which is contained in an ordinary developing solution. The processing solution for the activator process may contain components, such as an alkali and a co-developing agent. Examples of the activator processes are described in publicized literatures such as European Patent Nos. 545, 491A1 and 565,165A1.

Methods for developing a light-sensitive material by means of a processing solution containing a developing agent and a base are described in RD Nos. 17,643, pp. 28–29, 18,716, pp. 651, left column to right column, and 307,105, pp. 880–881.

Details of the processing material and processing method to be employed in the hot developing process in the present invention are given below.

The heat developable silver halide color photographic light-sensitive material of the present invention preferably contains a base or a base precursor in order to accelerate the development of silver and the dye forming reaction. Examples of the base precursor include a salt of an organic acid and a base capable of decarboxylation by means of heat and a compound capable of releasing an amine by means of an intramolecular neucleophilic substitution reaction, a Lossen rearrangement or a Beckmann rearrangement. Examples of these compounds are described in U.S. Pat. Nos. 4,514, 493 and 4,657,848 as well as in "Known Technologies" No. 5 (issued on Mar. 22, 1991, AZTEC Co., Ltd.), pp. 55–86. In addition, also usable in the present invention is a base generating method in which a combination of a sparingly water-soluble basic metal compound and a compound capable of reacting with the metal contained in the foregoing basic metal compound by use of water as a medium to form a complex compound (hereinafter referred to as a complex forming compound) is used, as described in and European Patent Application Laid-Open No. 210,660 and in U.S. Pat. No. 4,740,445.

The amount of the base or the base precursor to be used in the present invention is in the range of 0.1 to 20 g/m$^2$, preferably 1 to 10 g/m$^2$.

In order to accelerate the heat development, the heat developable silver halide color photographic light-sensitive material of the present invention may contain a thermal solvent, examples of which include polar organic compounds described in U.S. Pat. Nos. 3,347,675 and 3,667,959. Examples of such compounds include amide derivatives (e.g., benzamide), urea derivatives (e.g., methylurea and ethyleneurea), sulfonamide derivatives (e.g., compounds described in Japanese Patent Application Publication (JP-B) Nos. 1-40,974 and 4-13,701), polyol compounds (e.g., a sorbitol and a polyethylene glycol).

Where the thermal solvent is insoluble in water, preferably the thermal solvent is used as a solid dispersion. Depending on the purposes, the thermal solvent may be contained in any of a light-sensitive layer and non-light-sensitive layer.

The amount of the thermal solvent added is in the range of 10 to 500% by weight, preferably 20 to 300% by weight, based on the weight of the binder present in the layer to which the thermal solvent is to be added.

Although the heating temperature of the heat development process is in the range of about 50 to 250° C., the temperature is preferably in the range of 60 to 150° C., more preferably in the range of 70 to 100° C.

In order to supply a base, which is needed for the heat development process, to the light-sensitive material of the present invention, a processing material is used which has a processing layer containing a base or a base precursor. The processing material may have other functions, for example, a function to shut out the air at the time of heat development, a function to prevent the vaporization of the components of the heat developable silver halide color photographic light-sensitive material, a function to supply a material other than the base to the light-sensitive material and a function to remove a component of the light-sensitive material which becomes unnecessary after the development process (e.g., YF dye and AH dye) or an unnecessary component which is formed during the development process. The support and binder for the processing material can be the same as those for the light-sensitive material.

The processing material may contain a mordant for the removal of the dye as stated above or for other purpose. The mordant can be any of those known in the field of photography, examples of which include the mordants described in U.S. Pat. Nos. 4,500,626, columns 58–59, and in Japanese Patent Application Laid-Open (JP-A) No. 61-88, 256, pp. 32–41, 62-244,043 and 62-244,036. Further, the processing material can contain a dye acceptor polymeric compound described in U.S. Pat. No. 4,463,079, or the above-mentioned thermal solvent.

The processing layer of the processing material contains a base and/or a base precursor. The base may be either an organic base or an inorganic base. The base precursor may be any of those described hereinabove. The amount of the base or the base precursor to be used in the present invention is in the range of 0.1 to 20 g/m$^2$, preferably 1 to 10 g/m$^2$.

At the time when the light-sensitive material of the present invention undergoes the hot developing process utilizing the processing material, a small amount of water is used for such purposes as acceleration of development, acceleration of the transfer of the processing material, or acceleration of the diffusion of unnecessary substances as described in U.S. Pat. Nos. 4,704,245 and 4,470,445 and in Japanese Patent Application Laid-Open (JP-A) No. 61-238, 056. Such compounds as an inorganic salt of an alkali metal, an organic base, a solvent having a low boiling point, a surfactant, an anti-fogging agent, a compound forming a complex with a sparingly water-soluble metal salt, an anti-mold agent and an antibacterial agent may be added to the water.

The water is not particularly specified, and examples of the water include distilled water, tap water, well water and mineral water. In the hot developing apparatus utilizing the heat developable silver halide color photographic light-sensitive material of the present invention and the processing material, the waste water may be discarded without being reused or may be recycled for repeated use. When using recycled water, the water used accumulates the components leached out of the materials over repeated use. Further, the apparatus and water described in Japanese Patent Application Laid-Open (JP-A) Nos. 63-144,354, 63-144,355, 62-38,460 and 3-210,555 may be used in the present invention.

Water can be supplied to the heat developable silver halide color photographic light-sensitive material or to the processing material or to both of them. The amount of the water to be added ranges from 1/10 to the equivalent of an amount which is required for the maximum swelling of the entire coating layers (not including the back layer) composed of the heat developable silver halide color photographic light-sensitive material and the processing material.

For examples of methods of supplying this water, the methods outlined in Japanese Patent Application Laid-Open (JP-A) NO. 62-253159, p.5, and Japanese Patent Application Laid-Open (JP-A) No. 63-85544 are preferably used. It is also possible to trap solvent in microcapsules, and to internalize the solvent in the form of a hydrate in the silver halide color photographic light-sensitive material, processing material, or both. A water temperature of 30–60° C., as outlined in Japanese Patent Application Laid-Open (JP-A) No. 63-85544, is suitable.

When conducting a heat development of the light-sensitive material in the presence of a small amount of water, it is effective to adopt a method in which a combination of a sparingly water-soluble basic metal compound and a complex forming compound so that a base is generated, as described in and European Patent Application Laid-Open No. 210,660 and in U.S. Pat. No. 4,740,445. In this case, it is desirable to incorporate the sparingly water-soluble basic metal compound in the heat developable silver halide color photographic light-sensitive material and to incorporate the complex forming compound in the processing material, from the viewpoint of the storage stability of the raw materials.

Examples of the heating method in the developing process include a method in which the light-sensitive material is brought into contact with a heated block or plate, a method in which the light-sensitive material is brought into contact with such an object as a hot plate, a hot presser, a hot roller, a hot drum, a halogen lamp heater and an infrared or a far infrared lamp heater, and a method in which the light-sensitive material is passed through a hot atmosphere.

As for the method for plying the heat developable silver halide color photographic light-sensitive material and the processing material face to face so that the light-sensitive layer and the processing layer face each other, the methods, which are described in Japanese Patent Application Laid-Open (JP-A) Nos. 62-253,159 and 61-147,244, pp. 27, can be employed.

For the purpose of processing the light-sensitive material and the processing material of the present invention, any known apparatus for heat development can be used. Preferred examples of the apparatus include the apparatus described in Japanese Patent Application Laid-Open (JP-A) Nos. 59-75,247, 59-177,547, 59-181,353 and 60-18,951, Japanese Utility Model Application Laid-Open (JP-U) No. 62-25,944 and Japanese Patent Application Laid-Open (JP-A) Nos. 6-130,509, 6-95,338, 6-95,267, 8-29,955, and 8-29,954.

In addition, commercially available apparatus such as "Pictrostat" 100, 200, 300, 330 and 50 and "Pictrography" 3000 and 2000, manufactured by Fuji Photo Film Co., Ltd. Can be used in the present invention.

The heat developable silver halide color photographic light-sensitive material and/or the processing material of the present invention may have an electroconductive heat generator layer as a heating means for the heat development. For example, a heat generator layer described in Japanese Patent Application Laid-Open (JP-A) No. 61-145,544 can be used.

In the present invention, although the image information can be read out without removing the silver produced by development, and undeveloped light-sensitive silver halide from the light-sensitive material, it can be read out after removing the silver or silver halide. In the latter case, the silver or silver halide can be removed concurrently with or after the development.

In order to remove the developed silver from the heat developable silver halide color photographic light-sensitive material concurrently with the development or in order to complex or solubilize the silver halide, the processing material may contain a silver oxidizing or re-halogenating agent, which serves as a bleaching agent, and a solvent for the silver halide, which serves as a fixing agent, so that these reactions occur at the time of the heat development.

Further, after the developing process, a second processing material which contains a silver oxidizing or re-halogenating agent or a solvent for the silver halide and the heat developable silver halide color photographic light-sensitive material may be plied in order that the removal of the developed silver or the complexing or solubilizing of the light-sensitive silver halide be carried out.

In the present invention, in so far as the above-mentioned process does not provide adverse effects on the reading out of image information after development, it is preferable that the light-sensitive material be subjected to the above-mentioned process. Since the undeveloped light-sensitive silver halide causes significant haze in gelatin film to an extent that the background density increases, it is preferable to diminish the haze by use of the above-mentioned complexing agent or to solubilize the silver halide so that all or part of the silver halide is removed from the film.

From the viewpoint of reducing haze, it is preferable to use tabular silver halide grains having high aspect ratio or tabular silver halide grains containing silver chloride in high content, as described in the present invention.

In the present invention, a processing material can comprise a commonly used silver bleaching agent. Examples of a silver bleaching agent are described in U.S. Pat. Nos. 1,315,464 and 1,946,640 and in "Photographic Chemistry", vol. 2, chapter 30, Foundation Press, London, England. These bleaching agents effectively oxidize a silver image to make it soluble. Examples of useful silver bleaching agents include an alkali metal salt of dichromic acid and an alkali metal ferricyanide.

Preferred bleaching agents are a water-soluble compound, examples of which include ninhydrin, indandione, hexaketocyclohexane, 2,4-dinitrobenzoic acid, benzoquinone, benzenesulfonic acid and 2,5-dinitrobenzoic acid. The bleaching agents also include an organic complex of a metal, such as an iron (III) salt of cyclohexyldialkylaminetetraacetic acid, an iron (III) salt of ethylenediaminetetraacetic acid and an iron (III) salt of citric acid. The fixing agent can be a solvent for silver halide (i.e., solvent capable of dissolving silver halide) which can be used in the processing material for developing the heat developable silver halide color photographic light-sensitive material (the first processing material). The binder, support and other additives usable in the second processing material can also be the same substances as those usable in the first processing material.

The amount of bleaching agent to be added should be determined depending on the amount of silver contained in the heat developable silver halide color photographic light-sensitive material, and is in the range of 0.01 to 10 times, preferably 0.1 to 3 times, and more preferably 0.1 to 2 times the amount (mol) of silver present in the heat developable silver halide color photographic light-sensitive material per unit area.

The solvent for silver halide may be a known compound, examples of which include thiosulfates, such as sodium thiosulfate and ammonium thiosulfate, sulfites, such as sodium sulfite and sodium hydrogen sulfite, thiocyanates, such as potassium thiocyanate and ammonium thiocyanate, thioethers, such as 1,8-di-3,6-dithiaoctane, 2,2'-thiodiethanol, 6,9-dioxa-3,12-dithiatetradecane-1,14-diol as described in Japanese Patent Application Publication (JP-B) No. 47-11,386, a compound having a 5- or 6-membered imido ring, such as urasil and hydantoin as described in Japanese Patent Application Laid-Open (JP-A) No. 8-179,458, and a compound represented by the following general formula (V) as described in Japanese Patent Application Laid-Open (JP-A) No. 53-144,319. A mesoion thiolate compound of trimethyltriazolium thiolate described in "Analytica Chemica Acta", vol. 248, pp. 604 to 614 (1991), is also a preferred compound. A compound which is described in Japanese Patent Application Laid-Open (JP-A) No. 8-69,097 and which is capable of fixing a silver halide to stabilize it can also be used as a solvent for the silver halide.

General Formula (V)

$$N(R^{15})(R^{16})—C(=S)—Y—R^{17}$$

where Y represents a sulfur atom or an oxygen atom. $R^{15}$ and $R^{16}$, which maybe the same or different, each represent an aliphatic group, an aryl group, a heterocyclic group or an amino group. $R^{17}$ represents an aliphatic group or an aryl group. $R^{15}$ and $R^{16}$ or $R^{16}$ and $R^{17}$ may join together to form a 5-membered or a 6-membered heterocyclic ring. The above-described solvents for the silver halide may be used alone or in a combination of two or more of them.

Among the above-described compounds, a compound having a 5-membered or 6-membered imido ring, such as urasil or hydantoin, is particularly preferable. The addition of urasil or hydantoin in the form of potassium salt is preferable, because the salt can suppress gloss reduction during the storage of the processing material.

The content of the total amount of the solvent for silver halide in the processing layer is in the range of 0.01 to 100 mmol/$m^2$, preferably 0.1 to 50 mmol/$m^2$, and more preferably 10 to 50 mmol/$m^2$. The total amount of the solvent for the silver halide in the heat developable silver halide color photographic light-sensitive material is in the range of 1/20 to 10 times, preferably 1/10 to 10 times, and more preferably 1/3 to 3 times the amount (mol) of silver present in the light-sensitive material. When using the solvent for silver halide, it may be added to a solvent, such as water, methanol, ethanol, acetone, dimethylformamide or methylpropyl gycol, or to an alkaline or acidic aqueous solution, or otherwise a dispersion comprising fine solid grains of the solvent for the silver halidemaybe added to a coating solution.

Alternatively, the processing material may contain a physical development nucleus and the solvent for silver halide, so that the solvent for silver halide solubilizes the silver halide contained in the heat developable silver halide color photographic light-sensitive material concurrently with the development and so that the physical development nucleus reduces the soluble silver halide diffused from the heat developable silver halide color photographic light-sensitive material to convert it to physically developed silver which is to be fixed to a processing layer. Any physical development nucleus known as such can be used in the present invention. Examples of the physical development nucleus include colloidal grains of a heavy metal, such as zinc, mercury, lead, cadmium, iron, chromium, nickel, tin, cobalt, copper, and ruthenium, a precious metal, such as palladium, platinum, silver, and gold, a chalcogen compound composed of the foregoing and a substance such as sulfuric acid, selenium or tellurium. These physical development nucleus substances are obtained by reducing a corresponding metal ion utilizing such a reducing agent as ascorbic acid, sodium boron hydride or hydroquinone to produce a colloidal dispersion of metal or by mixing a metal ion with a solution comprising a soluble sulfide, selenide or telluride to produce a colloidal dispersion of insoluble metal sulfide, metal selenide or metal telluride, respectively. These colloidal grains are formed preferably in a hydrophilic binder such as gelatin. The method for preparing colloidal silver grains is described, for example, in U.S. Pat. No. 2,688,601. If necessary, a salt removing process may be conducted in the preparation of the colloidal silver, as is known in a method for preparing silver halide emulsion wherein excessive salt is removed.

The grain diameters of these physical development nuclei are preferably in the range of 2 to 200 nm.

The physical development nuclei are present in an amount ranging normally from $10^{-3}$ to 100 mg/m$^2$, preferably from $10^{-2}$ to 10 mg/m$^2$, in the processing layer.

Although the physical development nucleus may be prepared separately from a coating solution and thereafter the physical development nuclei may be added to the coating solution, the physical development nucleus may be prepared, for example, by the reaction between silver nitrate and sodium sulfide or between gold chloride and a reducing agent in a coating solution containing a hydrophilic binder.

Silver, silver sulfide, palladium sulfide or the like is preferably employed as a physical development nucleus. When using as an image the physically developed silver, which has been transferred to a processing material, it is preferable to use palladium sulfide, silver sulfide and the like, because they have small Dmin and high Dmax values.

Both the first processing material and the second processing material can have at least one polymerizable timing layer. The polymerizable timing layer can temporarily retard the bleaching and fixing reaction until the desired reaction among the silver halide, a dye forming compound and a developing agent substantially ends. The polymerizable timing layer may comprise gelatin, polyvinyl alcohol or a vinyl alcohol/vinyl acetate copolymer. This polymerizable timing layer may be a barrier timing layer as described in U.S. Pat. Nos. 4,056,394, 4,061,496 and 4,229,516.

The film thickness of the polymerizable timing layer is in the range of 5 to 50 $\mu$m, preferably 10 to 30 $\mu$m.

According to the present invention, the heat developable silver halide color photographic light-sensitive material after exposure thereof is bleached and fixed utilizing the second processing material. That is, the process comprises supplying water, in an amount ranging from 1/10 to the equivalent of an amount which is required for the maximum swelling of the total of the heat developable silver halide color photographic light-sensitive material layer and the second processing material layer excepting the back respective layers, to the light-sensitive material or to the second processing material, plying the light-sensitive material and the second processing material so that the light-sensitive layer and processing layer face each other and thereafter heating them to a temperature in the range of 40 to 100° C. for 5 to 60 seconds.

As for the amount of water, kind of water, method of supplying water and method of plying the light-sensitive material and the second processing material, the same as those in the case of the first processing material can be employed.

More specifically, the bleaching and fixing sheets described in Japanese Patent Application Laid-Open (JP-A) No. 59-136,733, U.S. Pat. No. 4,124,398 and Japanese Patent Application Laid-Open (JP-A) No. 55-28,098 can be used in the present invention.

For such purposes as improvement of the coatability, improvement of the releasability, improvement of the slipperiness, prevention of electrostatic charge and acceleration of developing reaction, a surfactant may be added to the heat developable silver halide color photographic light-sensitive material. Examples of the surfactants include those described in "Known Technologies" No. 5 (issued on Mar. 22, 1991, AZTEC Co., Ltd.), pp. 136–138 and in Japanese Patent Application Laid-Open (JP-A) Nos. 62-173,463 and 62-183,457.

For such purposes as prevention of slip, prevention of electrostatic charge and improvement of the releasability, an organic fluorine-containing compound may be added to the heat developable silver halide color photographic light-sensitive material. Typical examples of the organic fluorine-containing compounds include a fluorine-containing surfactant and a hydrophobic fluorine-containing compound, such as an oily fluorine-containing compound, e.g., fluorocarbon oil, and a solid fluorine-containing resin, e.g., tetrafluoroethylene, described in Japanese Patent Application Publication (JP-B) No. 57-9,053, columns 8–17, Japanese Patent Application Laid-Open (JP-A) Nos. 61-20,944 and 62-135,826.

Preferably, the heat developable silver halide color photographic light-sensitive material has a certain level of slipperiness. For this purpose, it is preferable that a slicking agent is contained both in the light-sensitive layer and in the back layer. A preferred level of slipperiness is indicated by a coefficient of dynamic friction in the range of 0.01 to 0.25, which is determined in a test comprising sliding the light-sensitive material at a rate of 60 cm/minute against stainless steel balls having a diameter of 5 mm (25° C., 60% RH). In this test, a value of nearly the same level is obtained even if the stainless steel balls are replaced with a light-sensitive layer.

Examples of usable slicking agents include polyorganosiloxanes, higher aliphatic acid amides, metal salts of higher fatty acid and esters made up of higher fatty acids and higher alcohols. Examples of the polyorganosiloxanes include polydimethylsiloxane, polydiethylsiloxane, polystyrylmethylsiloxane and polymethylphenylsiloxane. Polydimethylsiloxane and an ester having a long alkyl chain are particularly preferable. The layer to which the slicking agent is added is preferably the outermost light-sensitive layer or the back layer.

It is preferable to use an anti-static agent in the present invention. Polymers, which contain carboxylic acid, carboxylic acid salt or a sulfonic acid salt, cationic polymers and ionic surfactants can be used as the anti-static agent.

The preferred anti-static agent is grains of at least one type of crystalline metal oxide having grain sizes in the range of 0.001 to 1.0 $\mu$m, selected from the group consisting of ZnO, $TiO_2$, $SnO_2$, $Al_2O_3$, $In_2O_3$, $SiO_2$, MgO, BaO, $MoO_3$ and $V_2O_5$ and having a volume resistivity of $10^7$ $\Omega$·cm or less, preferably $10^5$ $\Omega$·cm or less, or grains of a complex oxide thereof, for example, complex of an element such as Sb, P, B, In, S, Si, C and the like and the foregoing metal oxide. The amount of an anti-static agent present in the heat developable silver halide color photographic light-sensitive material is preferably in the range of 5 to 500 mg/$m^2$, more preferably in the range of 10 to 350 mg/$m^2$. The ratio of the electroconductive crystalline oxide or the complex oxide thereof to a binder is preferably in the range of 1/300 to 100/1, more preferably 1/100 to 100/5.

The heat developable silver halide color photographic light-sensitive material or processing material (including back layers) can contain a polymer latex in order to improve film physical properties such as dimension stability, prevention of curling, prevention of adhering, prevention of film cracking and prevention of pressure-induced sensitization or desensitization. Any and all polymer latices, which are described in Japanese Patent Application Laid-Open (JP-A) Nos. 62-245,258, 62-136,648 and 62-110,066, can be used in the present invention. Particularly, the utilization of a polymer latex having a low glass transition point (40° C. or less) in the mordant layer of the processing material can prevent cracking of the mordant layer, while the utilization of a polymer latex having a high glass transition point in the back layer can prevent curling.

Preferably, the heat developable silver halide color photographic light-sensitive material of the present invention contains a matting agent. Although the matting agent may be added to either the light-sensitive layer containing silver halide emulsion or the back layer, it is particularly preferable that the matting agent be added to the outermost layer on the same side of the support as the light-sensitive layer is provided. Although the matting agent may be soluble or insoluble in a processing solution, it is preferable to use a combination of a soluble matting agent and an insoluble matting agent in the present invention. An example of such a combination of matting agents comprises grains of polymethyl methacrylate, poly(methyl methacrylate/methacrylic acid) (in a molar ratio of 9/1 or 5/5) and polystyrene. The matting agent has average grain diameters preferably in the range of 0.8 to 10 $\mu$m and preferably has a narrow range of grain diameter distribution. It is preferable that 90% or more of the total number of the grains have a diameter falling in the range of 0.9 to 1.1 times the average grain diameter. Meanwhile, in order to enhance the matting effect, it is also preferable to use fine grains having a grain diameter of 0.8 $\mu$m or less, together with the matting agent having the above-mentioned grain diameter. Examples of fine grains include grains of polymethyl methacrylate (0.2 $\mu$m), grains of poly(methyl methacrylate/methacrylic acid) (in a molar ratio of 9/1, 0.3 $\mu$m ), grains of polystyrene (0.25 $\mu$m) and grains of colloidal silica (0.03 $\mu$m).

Concrete examples of the matting agent are described in Japanese Patent Application Laid-Open (JP-A) No. 61-88, 256, pp. 29. Other examples of the matting agent are such materials as benzoguanamine resin beads, polycarbonate beads and AS resin beads, all of which are described in Japanese Patent Application Laid-Open (JP-A) Nos. 63-274, 944 and 63-274,952. Further, the compounds which are described in the aforesaid Research Disclosure can be employed as the matting agent.

In the present invention, a support for the heat developable silver halide color photographic light-sensitive material and the processing material needs to be able to withstand the processing temperature. Generally, examples of the support are paper, a synthetic polymer (film) and the like, as described in "Syashinkogaku no kiso—Ginen Syashin Hen (Fundamentals of Photographic Engineering—Silver Salt Photography Section)", pp. 223–240, edited by Photographic Society of Japan, Corona Co., Ltd., 1979. Concrete examples of the support include polyethylene terephthalate, polyethylene naphthalate, polycarbonate, polyvinyl chloride, polystyrene, polypropylene, polyimide and cellulose (e.g., triacetylcellulose).

These materials may be used alone. Further, a support in which a synthetic polymer such as polyethylene may be laminated to one side or both sides of paper can be used.

Other supports, which can be used in the present invention, include those described in Japanese Patent Application Laid-Open (JP-A) Nos. 62-253,159, pp. 29–31, 1-161,236, pp. 14–17, 63-316,848, 2-22,651 and 3-56,955 and U.S. Pat. No. 5,001,033.

Where requirements of resistance to heat and curling are stringent, preferred examples of the support for heat developable silver halide color photographic light-sensitive material are those described in Japanese Patent Application Laid-Open (JP-A) Nos. 6-41,281, 6-43,581, 6-51,426, 6-51, 437, 6-51,442, 6-82,961, 6-82,960, 6-123,937, 6-82,959, 6-67,346, 6-118,561, 7-219,129 and 7-219,144.

Also preferable is a support mainly made from a styrene-based polymer having a syndiotactic structure.

In order to bond the photographic layer to the support, it is preferable that the support be surface-processed. Examples of the surface processes include a chemical process, a mechanical process, a corona discharge process, a flame process, an ultraviolet ray process, a high frequency wave process, a glow discharge process, an activated plasma process, a laser process, a mixed acid process and an ozone-oxidation process. Among these surface processes, an ultraviolet irradiation process, a flame process, a corona discharge process and glow discharge process are preferable.

A prime layer may comprise single layer or may comprise two or more layers. Examples of the binder for the prime layer include a copolymer, which is made up of a monomer selected from the group consisting of vinyl chloride, vinylidene chloride, butadiene, methacrylic acid, acrylic acid, itaconic acid, maleic anydride and the like, polyethylene imine, an epoxy resin, grafted gelatin, nitrocellulose and gelatin. Examples of the compound, which swells the support, include resorcin and p-chlorophenol. The prime layer may contain a gelatin-hardening agent such as chromates (e.g., chrome alum), aldehydes (e.g., formaldehyde and glutaric aldehdye), isocyanates, active halogen compounds (e.g., 2,4-dichloro-6-hydroxy-s-triazine), an epichlorohydrin resin and active vinylsulfonic compounds. Further, the prime layer may contain $SiO_2$, $TiO_2$ grains of an inorganic material or grains of a copolymer of polymethyl methacrylate (0.01 to 10 $\mu$m) as a matting agent.

In addition, it is preferable to record photographic information and the like by use of a support which is provided with a magnetic recording layer and is described in Japanese Patent Application Laid-Open (JP-A) Nos. 4-124,645, 5-40, 321, 6-35,092 and 6-317,875.

A magnetic recording layer is formed by coating onto a support an aqueous or organic solvent-based coating solution comprising a binder and magnetic grains dispersed therein.

Examples of usable magnetic grains include ferromagnetic iron oxide such as $\gamma$-$Fe_2O_3$, Co-covered $\gamma$-$Fe_2O_3$, Co-covered magnetite, Co-containing magnetite, ferromagnetic chromium dioxide, ferromagnetic metals, ferromagnetic alloys, hexagonal Ba-ferrite, Sr-ferrite, Pb-ferrite and Ca-ferrite. A Co-covered ferromagnetic iron oxide such as Co-covered $\gamma$-$Fe_2O_3$ is preferable. The shape of the magnetic grains may be selected from the group consisting of needles, grains, spheres, cubes and plates. The specific surface area in $S_{BET}$ is preferably 20 $m^2/g$ or greater, more preferably 30 $m^2/g$ or greater. The saturation magnetization ($\sigma s$) of the ferromagnetics is preferably in the range of $3.0\times10^4$ to $3.0\times10^5$ A/m, more preferably $4.0\times10^4$ to $2.5\times10^5$ A/m. The ferromagnetic grains may be surface-processed with silica and/or alumina or with an organic substance. Further, as described in Japanese Patent Application Laid-Open (JP-A) No. 6-161,032, the ferromagnetic grains may be surface-processed with a silane coupling agent or with a titanium coupling agent. Magnetic grains, which are covered with an inorganic or organic substance and are described in Japanese Patent Application Laid-Open (JP-A) Nos. 4-259,911 and 5-81,652, can also be used in the present invention.

As described in Japanese Patent Application Laid-Open (JP-A) No. 4-219,569, the binders usable together with the magnetic grains are thermoplastic resin, thermosetting resin, radiation-curable resins, reactive resins, acid-, alkali- or biodegradable polymers, naturally occurring polymers (e.g., cellulose derivatives and derivatives of saccharides) and mixtures thereof. These binders have a Tg in the range of −40 to 300° C. and a weight-average molecular weight in the range of 2,000 to 1,000,000. Preferred examples of the binder include vinyl-based copolymers, cellulose derivatives, such as cellulose diacetate, cellulose triacetate, cellulose acetatepropionate, cellulose acetatebulylate and cellulose tripropionate, acrylic resins, polyvinyl acetal resins and gelatin. Cellulose di(tri)acetate is particularly preferable. The binder may be hardened by use of a crosslinking agent such as an epoxy-type, aziridine-type or isocyanate-type crosslinking agent. Examples of the isocyanate-type crosslinking agent include isocyantes, such as tolylenediisocyanate, 4,4'-diphenylmethanediisocyanate, hexamethylenediisocyanate and xylylenediisocyanate, a reaction product of any of these isocyanates and a polyalcohol (e.g., a tolylenediisocyanate/trimethylol propane in 3/1 molar ratio adduct) and a polyisocyanate produced by a condensation reaction of these isocyanates, all of which are described, for example, in Japanese Patent Application Laid-Open (JP-A) No. 6-59,357.

As described in Japanese Patent Application Laid-Open (JP-A) No. 6-35,092, the aforementioned magnetic grains are dispersed in a binder preferably by means of a kneader, a pin-type mill or an annular mill. A combination of these dispersing means is also preferable. A dispersant, such as the dispersant described in Japanese Patent Application Laid-Open (JP-A) No. 5-88,283 and other known dispersants, may be used in order to disperse the magnetic grains in the binder.

The thickness of the magnetic recording layer is in the range of 0.1 to 10 $\mu$m, preferably 0.2 to 5 $\mu$m, and more preferably 0.3 to 3 $\mu$m. The ratio of the weight of the magnetic grains to the weight of the binder is preferably in the range of 0.5:100 to 60:100, more preferably 1:100 to 30:100.

The coated weight of the magnetic grains is usually in the range of 0.005 to 3 $g/m^2$, preferably 0.01 to 2 $g/m^2$ and more preferably 0.02 to 0.5 $g/m^2$.

The transmission yellow density of the magnetic recording layer is preferably in the range of 0.01 to 0.50, more preferably 0.03 to 0.20, and most preferably 0.04 to 0.15. The magnetic recording layer may be formed on the entire surface or in a stripe on the reverse side of a photographic support by coating or printing the coating solution for forming the magnetic recording layer. Employable methods for forming the magnetic recording layer include an air doctor method, a blade method, an air knife method, squeezing, impregnation, reverse roll coating, transfer roll coating, gravure coating, kissing, casting, spraying, dipping, bar coating and extrusion. The coating solution, which is described, for example, in Japanese Patent Application Laid-Open (JP-A) No. 5-341,436, is preferably used.

The magnetic recording layer may also function in the enhancement of lubrication, control of curling, prevention of electrostatic charge, prevention of adhering and head polishing. Also, another functional layer having any of these functions may be formed. The abrasive grains, which impart a head polishing function to the magnetic recording layer or to another functional layer, preferably contain at least one type of grain having a Moh's hardness of 5 or greater and are non-spherically shaped inorganic grains. Examples of non-spherical inorganic grains include oxides, such as aluminum oxide, chromium oxide, silicon dioxide and titanium dioxide, carbides, such as silicon carbide and titanium carbide, and diamond. The surface of abrasive grains may be processed with a silane coupling agent or with a titanium coupling agent. These grains may be added to the magnetic recording layer. Alternatively, the magnetic recording layer may be overcoated with a coating solution (e.g., a protective layer and lubricating layer) containing these grains. As for the binder in the overcoat, the same binders as those mentioned above may be used, and the binder in the overcoat is preferably the same as that for the magnetic recording layer. The light-sensitive materials having a magnetic recording layer are described in U.S. Pat. Nos. 5,336,589, 5,250,404, 5,229,259 and 5,215,874 and in EP 466,130.

A polyester support, which is preferably used in the light-sensitive material having the above-described magnetic recording layer, is described below. Details of the polyester support along with a light-sensitive material, a processing procedure, a cartridge and examples in use thereof are shown in JIII Journal of Technical Disclosure No. 94-6,023 (issued on Mar. 15, 1994 from The Japan Institution of Invention and Innovation).

The polyester is made up of a diol and an aromatic dicarboxylic acid. Examples of the aromatic dicarboxylic acid include 2,6-, 1,5-, 1,4- and 2,7-naphthalenedicarboxylic acid, terephthalic acid, isophthalic acid and phthalic acid. Examples of the diol include diethylene glycol, triethylene glycol, cyclohexanedimethanol, bisphenol A and bisphenol. Examples of polymers, which are formed from theses monomers, include homopolymers such as polyethylene terephthalate, polyethylene naphthalate and polycyclohexanedimethanol terephthalate. A polyester, in which 2,6-naphthalenedicarboxylic acid comprises 50 to 100 mol % of the carboxylic acid monomer composition, is preferable, and polyethylene-2,6-naphthalate is particularly preferable. The average molecular weight of the polyester is in the range of about 5,000 to 200,000. Tg of the polyester is 50° C. or greater, preferably 90° C. or greater.

Next, in order to make the polyester support low-curling, the polyester support is subjected to a heat process at a temperature which is preferably 40° C. to Tg, more preferably (Tg−20)°C. to Tg. The heat process may be carried out in a continuous manner at a temperature within the above-mentioned range, or it may be carried out discontinuously so that a cooling step is effected between heat-processing steps. The duration of the heat process is preferably in the range of 0.1 to 1,500 hours, more preferably 0.5 to 200 hours. The heat process may be effected while the support is held in the shape of a roll, or the heat process may be effected while the support is in the shape of a web while being carried. Electroconductive inorganic grains, such as $SnO_2$ and $Sb_2O_5$, may be provided onto the surface of the support to impart surface roughness so that the surface condition is improved. Further, it is preferable that the support be designed in such a way that the tips of the roll are slightly elevated relative to other parts so that transfer of the cut end mark in the roll core is prevented. Although the heat process may be carried out after film forming, after surface process, after application of back layer (e.g., antistatic agent, sticking agent or the like) and after application of primer, the heat process is carried out preferably after the application of an anti-static agent.

An ultraviolet absorber may be blended into the polyester in accordance with its purpose. Further, in order to prevent light piping, a dye or pigment, commercialized for polyester use under the names of "Diaresin" (from Mitsubishi chemical Industries, Co., Ltd.) or "Kayaset" (from Nihon Kayaku Co., Ltd.) may be blended into the polyester.

A film patrone (a film case), into which the heat developable silver halide color photographic light-sensitive material of the present invention may be encased, is explained below. The main material of the film patrone may be a metal or a synthetic plastic. Among these, plastic is preferable.

Preferred examples of the plastic material include polystyrene, polyethylene, polypropylene and polyphenyl ether. The film case may contain an anti-static agent, examples of which include carbon black, metal oxide grains, surfactants, such nonionic, anionic, cationic or betaine-based surfactants, and polymers. Examples of the film patrone, which have been rendered antistatic, are described in Japanese Patent Application Laid-Open (JP-A) Nos. 1-312,537 and 1-312,538. The resistivity of the film patrone is preferably $10^{12}$ Ω·cm or less in a condition of 25° C. and 25% RH. Normally, carbon black or a dye is incorporated into the plastic film patrone in order to afford shading. The size of the film patrone may be the 135 size which is currently employed (the diameter of cartridge of the 135 size is 25 mm). For use in a small-sized camera, a film patrone having a diameter of the cartridge of 22 mm or less may be used. The volume of the film patrone is 30 $cm^3$ or less, preferably 25 $cm^3$ or less. The weight of the plastics for a film patrone is preferably in the range of 5 to 15 g.

A film patrone which feeds out film by the rotation of a spool may be used for the light-sensitive material of the present invention. A film patrone wherein the end of the film is fed from the port of the film patrone to the outside by rotating the spool axis in the direction of the feed of the film can also be used. These film patrones are described in U.S. Pat. Nos. 4,834,306 and 5,226,613.

As for the method to form an image on a sheet of color paper or on a heat developable silver halide color photographic light-sensitive material, the methods, which are described in Japanese Patent Application Laid-Open (JP-A) Nos. 5-241,251, 5-19,364 and 5-19,363, can be used.

EXAMPLES

The examples of the present invention will now be explained. However, the present invention is in no way limited by these examples.

Example 1

1000 ml of distilled water containing Gelatin, 30.0 g, sodium chloride, 3.4 g, sulfuric acid (1N), 20.0 ml was put into a reactor and heated to $_{55}$° C. 1.7 ml of an aqueous solution of N,N'-dimethylimidazoridine-2-thion (1%), was added to the solution. While the solution obtained was vigorously stirred, 2000 ml of an aqueous solution containing 7.1 g of silver nitrate, and 200 ml of an aqueous solution containing 2.41 g of sodium chloride were added to the solution over the course of 24 minutes. Next, 500 ml of an aqueous solution containing 162.8 g of silver nitrate, and 500 ml of an aqueous solution containing 59.88 g of sodium chloride were added to the solution over the course of 80 minutes while increasing the rate of flow of addition. Sixty minutes after the initial addition of these reactants, 0.04 mg of potassium hexachloroiridate was added. After addition of all the reactants, the solution was maintained at 55° C. for five minutes, cooled and desalted through a standard technique.

The emulsion obtained was made up of cubic grains 0.69 μm in average grain size, defined as the average diameter of spheres having equivalent grain volume. This emulsion was designated as Emulsion A-1.

1000 ml of distilled water containing 21.2 g of gelatin with an average molecular weight of 15,000, 85 g of sodium chloride and 3.8 ml of sulfuric acid (1N) was put into a reactor and heated to 40° C. Thirty ml of an aqueous solution containing 6.1 g of silver nitrate, and 30ml of an aqueous solution containing 2.00 g of sodium chloride and containing 0.21 g of potassium bromide were added to the solution in 45 seconds during strenuous mixing. After this, 40ml of an aqueous solution containing 0.55 g of potassium bromide was added. Next, 100 ml of an aqueous solution containing 18.3 g of silver nitrate, and 100 ml of an aqueous solution containing 6.30 g of sodium chloride were added over three minutes. After the addition of 6.0 ml of (1N) sodium hydroxide, the temperature of the reaction solution was raised to 75° C. After the addition of 100 ml of distilled water and 10.0 g of gelatin, 750 ml of an aqueous solution containing 145.4 g of silver nitrate, and a 7.0% sodium chloride aqueous solution were added over 45 minutes, while, at the same time, the rate of flow of addition was raised, and the reaction solution developed a silver potential of 120 mV, with respect to a saturated calomel electrode. After the addition of 0.04 mg of potassium hexachloroiridate, the solution was maintained at 75° C. for 30 minutes. Upon cooling, it was desalted through a standard technique and the light-sensitive silver halide emulsion was obtained. 81% of total projected area of silver halide grains contained in the light-sensitive silver halide emulsion was taken up by tabular silver chlorobromide grains having a silver bromide content of 0.64%, average grain size, which was defined as the average diameter of spheres having equivalent grain volume, of 0.69 μm, an aspect ratio, formed by dividing the diameter of a sphere having the same projected area as the grains by the average thickness of the grains, of 7.1, the rectangle projected plane having an average length to breadth ratio of 1:1.25, and the main outer surface composed of a (100) plane. This emulsion was designated as Emulsion A-2.

An emulsion was prepared in the same manner as in the preparation of Emulsion A-2 except oxidation-processed gelatin was used in place of the gelatin employed in the preparation of Emulsion A-2, and hydrogen peroxide was used at the time of grain formation. 78% of total projected area of silver halide grains contained in the light-sensitive silver halide emulsion was taken up by tabular silver chlorobromide grains having a silver bromide content of 0.64%, average grain size, which was defined as the average diameter of spheres having equivalent grain volume, of 0.69 μm, an aspect ratio of, formed by dividing the diameter of a sphere having the same projected area as the grains by the average thickness of the grains, of 27, the rectangle projected plane having an average length to breadth of 1:1.25, and the main outer surface composed of an (100) plane. This emulsion was designated as Emulsion A-3.

Next, 930 ml of distilled water containing 0.74 g of gelatin with an average molecular weight of 15,000 and 0.7 g of potassium bromide was put into a reactor and heated to 40° C. A further 30 ml of an aqueous solution containing 1.2 g of silver nitrate, and 30 ml of an aqueous solution containing 0.82 g of potassium bromide were added to the above solution over 30 seconds during vigorous stirring. These solutions were added, and the temperature of the resultant solution was maintained at 40° C. for 1 minute. Thereafter, the temperature was raised to 75° C. After adding 27.0 g of gelatin along with 200 ml of distilled water, 100 ml of distilled water containing 22.5 g of silver nitrate, and 80 ml of an aqueous solution containing 15.43 g of potassium bromide were added over the course of 11 minutes, while the rate of flow of addition was raised. Next, 250 ml of an aqueous solution containing 75.1 g of silver nitrate, and an aqueous solution containing potassium iodide and potassium bromide at a respective molar ratio of 3:97 (potassium bromide concentration 26%), were added over the course of 20 minutes, while the rate of flow of addition was raised and the resultant solution developed a silver potential of −20 mV with respect to a saturated calomel electrode. Another 75 ml of aqueous solution containing 18.7 g of silver nitrate, and 21.9% aqueous solution containing potassium bromide was added over 3 minutes, while the resultant solution developed a silver potential of −40mV, with respect to a saturated calomel electrode. After this addition and maintenance of the temperature at 75° C. for one minute, the solution was cooled to 55° C. Then, 120 ml of an aqueous solution containing 8.1 g of silver nitrate, and 320 ml of an aqueous solution containing 7.26 g of potassium iodine were added over five minutes. After this addition, 5.5 g of potassium bromide and 0.04 mg of potassium hexachloroiridate were added, and after being maintained at 55° C. for one minute, 180 ml of an aqueous solution containing 44.3 g of silver nitrate, and 160 ml of an aqueous solution containing 34.0 g of potassium bromide were added over the course of eight minutes. After this, the solution was cooled and desalted through a standard technique. The light sensitive silver halide emulsion was made up of hexagonal tabular grains having average grain size, which was defined as the average diameter of spheres having equivalent grain volume, of 0.66 μm, and an aspect ratio, formed by dividing the diameter of a sphere having the same projected area as the grains by the average thickness of the grains, of 6.2. The emulsion was designated as Emulsion A-4.

The spectral sensitization and the chemical sensitization of each of the EmulsionA-1 to A-4 was effected by the addition of the following spectrally sensitizing dyes (sensitizing dyes for green-sensitive emulsion I–III), potassium thiocyanate, chloroauric acid, and sodium thiosulfuric acid. At this time, the spectrally sensitizing dyes were added in the molar proportion of the respective spectrally sensitizing dyes I:II:III of 28:7:1 for every mole of silver. All together, $1.2\times10^{-3}$ moles were administered. The amount of additive given to each emulsion was given in proportion to the grain surface area. Also the value of pAg at the time of chemical sensitization and the amount of chemical sensitizer given at the time of chemical sensitization was adjusted so that the optimum chemical sensitivity could be obtained. In this way, green-sensitive emulsions A-1g to A-4g were prepared. Sensitizing dye I for green-sensitive emulsion

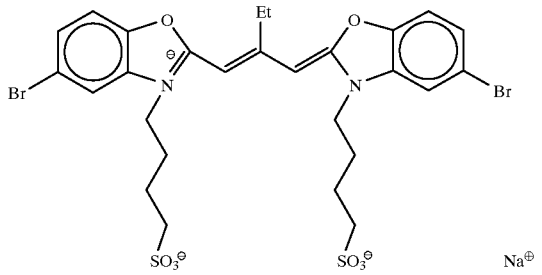

Sensitizing dye II for green-sensitive emulsion

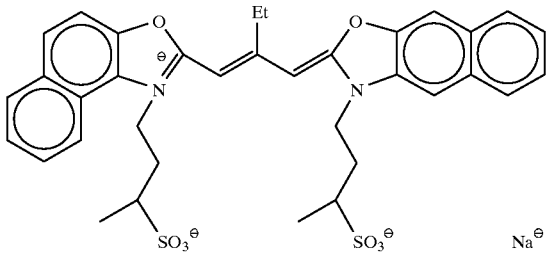

Sensitizing dye III for green-sensitive emulsion

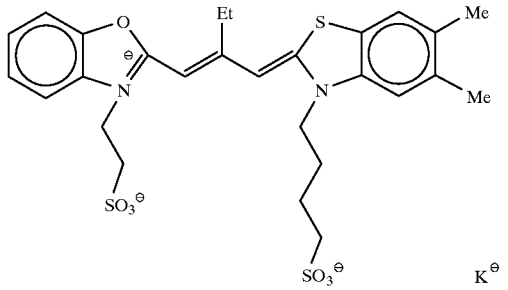

Next, the zinc hydroxide dispersion used as a base precursor, was prepared in the following way: 31 g of zinc hydroxide powder with primary grain size of 0.29 μm, 1.6 g of carboxymethylcellulose as the dispersing agent, 0.4 g of sodium polyacrylate, 8.5 g of lime-processed ossein gelatin, and 158.5 ml of water were all mixed together. This mixture was then dispersed for one hour in a glass bead mill. After being dispersed, the glass beads were removed and 188 g of a zinc hydroxide dispersion was obtained.

A magenta coupler emulsion was prepared in the following manner: 7.80 g of the magenta coupler (a), 5.45 g of developing agent (b), 8.21 g of high boiling point organic solvent (d), and 24.0 ml of ethyl acetate were all dissolved at 60° C. The solution was blended into 150 g of an aqueous solution comprising 12.0 g of a lime-processed gelatin and 0.6 g of a sodium dodecylbenzensulfonate. The resultant mixture was emulsified by means of a dissolver-type mixing device rotating at 10,000 revolutions per minute over a period of 20 minutes. After the emulsification, distilled water was added to the emulsion so that the total volume became 300 g, and the resultant liquid was mixed at 2,000 revolutions per minute for 10 minutes.

A color photographic light-sensitive material which was designated as Sample 101, was prepared by the procedure combining the above-described dispersions with the light-sensitive silver halide emulsion to produce the composition as shown in Table 1 and thereafter coating the obtained composition onto a support. Table 2 is a detailed description of PET support A of table 1.

TABLE 1

PET support A

| Layer | Main elements | Coating amount ($mg/m^2$) |
|---|---|---|
| Protective layer | Lime-processed gelatin | 1000 |
| | Matting agent (silica) | 50 |
| | Surfactant (f) | 100 |
| | Surfactant (g) | 300 |
| | Water-soluble polymer (h) | 15 |
| | Hardener (I) | 35 |
| Intermediate layer | Lime-processed gelatin | 375 |
| | Surfactant (g) | 15 |
| | Zinc hydroxide | 1100 |
| | Water-soluble polymer (h) | 15 |
| Magenta dye forming layer | Lime-processed Gelatin | 2000 |
| | Emulsion (based on the amount of coated silver) | A-1g 863 |
| | Magenta coupler (a) | 637 |
| | Developing agent (b) | 444 |
| | High boiling point organic solvent (d) | 670 |
| | Surfactant (g) | 33 |
| | Water-soluble polymer (h) | 14 |

TABLE 2

Support: polyethelyne terephthalate (with gelatin subbing layer, 100 $\mu m$)

| Layer name | Composition | Coating amount ($mg/m^2$) |
|---|---|---|
| First back coat layer (conductive layer | Lime-processed gelatin | 60 |
| | Tin oxide-antimony oxide complex grains of 0.005 $\mu m$ in average grain diameter (specific resistivity 5Ω · cm, secondary aggregated grain size approx. 0.08 $\mu m$) | 180 |
| | Polyoxyethylene-p-nonylphenol | 5 |
| Second back coat layer | Lime-processed gelatin | 2000 |
| | Surfactant (g) | 11 |
| | Hardener (2) | 455 |
| | PMMA latex (average grain size 6 $\mu m$) | 9 |
| Third back coat layer | Methyl methacrylate/styrene/2-ethylhexyl acrylate/methacrylic acid copolymer | 1000 |
| | Surfactant (g) | 1.5 |
| | Surfactant (e) | 20 |
| | Surfactant (4) | 2.5 |

Magenta coupler (a)

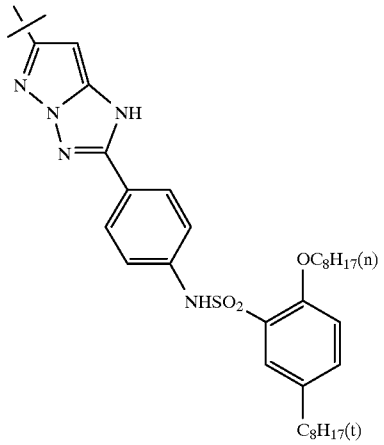

Developing agent (b)

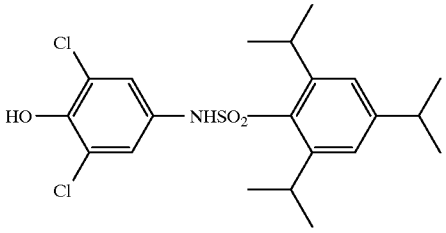

Surfactant (g)

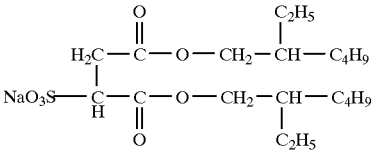

High boiling point organic solvent (d)

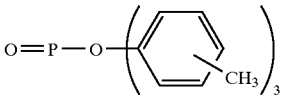

Surfactant (e)

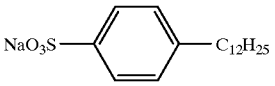

Hardener (2)

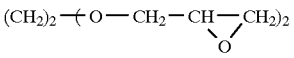

Surfactant (4)

$C_{16}H_{33}OSO_3Na$

Surfactant (f)

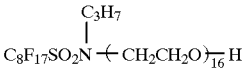

-continued

Water-soluble polymer (h)

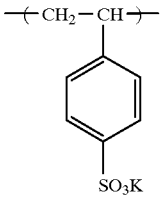

Hardener (i)

$$CH_2{=}CH{-}SO_2{-}CH_2{-}SO_2{-}CH{=}CH_2$$

Apart from changing A-2g to A-4g for the emulsion from the magenta dye forming layer of sample 101, the light-sensitive materials (sample 102–104) were prepared in the same way as sample 101. Next, apart from adding the compounds expressed by the formulas (I) to (IV) respectively to the magenta dye forming layer, heat developable silver halide color photographic light-sensitive materials (samples 105 to 111) were prepared in the same way as were samples 101–104.

Apart from adding the compounds expressed respectively by the formulas (I) to (IV) to the intermediate layer of sample 101, the light-sensitive material (sample 112) was prepared in the same way as was sample 101.

The types and the amounts added of emulsions and compounds expressed by the formulas (I) to (IV) used in the magenta dye forming layer of the light-sensitive material are displayed in Table 3.

TABLE 3

| Sample | Emulsion type | Compounds from the formulas (I)–(IV) Type | Amount added (mmol/1 mol silver coat) | Reference |
|---|---|---|---|---|
| 101 | A-1g | — | — | C.E. |
| 102 | A-2g | — | — | C.E. |
| 103 | A-4g | — | — | C.E. |
| 104 | A-3g | — | — | C.E. |
| 105 | A-1g | A-3 | 1.0 | C.E. |
| 106 | A-2g | A-3 | 1.0 | P.I. |
| 107 | A-4g | A-3 | 1.0 | C.E. |
| 108 | A-3g | A-3 | 1.0 | P.I. |
| 109 | A-2g | A-3 | 2.0 | P.I. |
| 110 | A-2g | A-27 | 1.0 | P.I. |
| 111 | A-2g | A-36 | 1.0 | P.I. |
| 112 | A-2g | A-20 | 2.0 | P.I. |

C.E. = comparative example
P.I. = present invention

Next, as outlined in tables 4 and 5, the processing material P-11 was prepared. Table 5 shows the details of the PET support B of table 4. Apart from the addition of 40 mg/m$^2$ of compound A-3 enumerated as a practical example of the compounds used in the present invention and expressed by formulas (I) to (IV), to the topmost layer of processing material P-11, processing material P-12 was prepared in the same way as processing material p-11.

TABLE 4

| PET support B (thickness: 63 μm) | | |
|---|---|---|
| Layer structure | Addition element | Coating amount (mg/m$^2$) |
| Fourth layer protective layer | Acid-processed gelatin | 220 |
| | Water-soluble polymer (j) | 60 |
| | Water-soluble polymer (k) | 200 |
| | Additive (l) | 80 |
| | Palladium sulfide | 3 |
| | Potassium nitrate | 12 |
| | Matting agent (m) | 10 |
| | Surfactant (g) | 7 |
| | Surfactant (n) | 7 |
| | Surfactant (o) | 10 |
| | Surfactant (o) | |
| Third layer intermediate layer | Lime-processed gelatin | 240 |
| | Water-soluble polymer (k) | 24 |
| | Hardener (p) | 180 |
| | Surfactant (e) | 9 |
| Second layer base generating layer | Lime-processed gelatin | 2400 |
| | Water-soluble polymer (k) | 360 |
| | Water-soluble polymer (q) | 700 |
| | Water-soluble polymer (r) | 600 |
| | High boiling point solvent (s) | 2000 |
| | Additive (t) | 20 |
| | Potassium hydantoin | 260 |
| | Guanidine picolinic acid | 2910 |
| | Potassium quinolinate | 225 |
| | Sodium quinolinate | 180 |
| | Surfactant (e) | 24 |
| First layer prime layer | Lime-processed gelatin | 280 |
| | Water-soluble polymer (j) | 12 |
| | Surfactant (g) | 14 |
| | Hardener (p) | 185 |

TABLE 5

| Layer name | Substance | coating amount (mg/m$^2$) |
|---|---|---|
| Surface prime layer | Gelatin | 100 |
| Polymer layer | Polyethylene terephthalate | 62500 |
| Converse side prime layer | Methyl methacrylate/styrene/2-ethylhexyl acrylate/methacrylic acid copolymer | 1000 |
| | PMMA latex (average grain size: 12 μm) | 120 |
| | Total | 63,720 |

Water-soluble polymer (j): κ-carrageenan

Water-soluble polymer (k): Sumikagel L-5H (from Sumitomo Chemical Co., Lte.)

Additive (1):

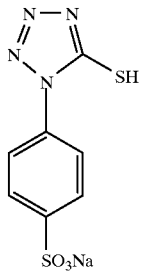

Matting Agent (m):

SYLOID 79 (from Fuji-Davison Chemical Co., Ltd.)

Surfactant (n):

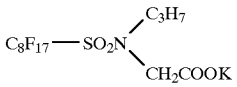

Surfactant (o):

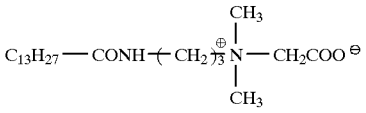

Hardener (p):

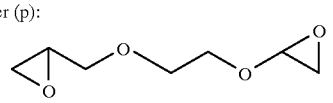

Water-soluble polymer (q):

Dextran (molecular weight: 70,000)

Water-soluble polymer (r):

MP Polymer MP 102 (from Kuraray Co., Ltd.) High boiling point organic solvent (s):

En-Para 40 (from Ajinomoto Co., ltd.)

Additive (t):

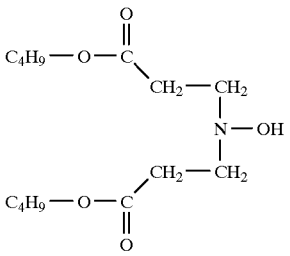

All of the above light-sensitive materials samples 101–112) were exposed to 1000 lux for $100_{th}$ of a second through an optical wedge and a green filter.

After exposure, 15 ml/m$^2$ of water at 40° C. was applied to the surface of all the light-sensitive materials (samples 101–112). After plying the processing layer surface of processing material p-11 with the light-sensitive layer surface of the light-sensitive material, heat development was carried out at 85° C. for 15 seconds with a heat drum. After this heat development process, the light-sensitive material and processing material were separated from each other, and a magenta wedge-shaped image was formed.

Next, the second process of samples 101–112 was carried out with the second processing material. After coating the second processing material with 10 cc/m$^2$ of water, it was plied with light-sensitive material (samples 101–112) from after the first process, and heated to 60° C. for 30 seconds. The second processing materials are listed in detail in table 6. The details of the PETG support B are shown in Table 5.

TABLE 6

PET support B (thickness: 63 μm)

| Layer structure | Addition element | Coating amount (mg/m$^2$) |
|---|---|---|
| Fourth layer | Acid-processed gelatin | 220 |
| | Water-soluble polymer (j) | 60 |
| | Water-soluble polymer (k) | 200 |
| | Potassium nitrate | 12 |
| | Matting agent (m) | 10 |
| | Anionic Surfactant (g) | 7 |
| | Anionic Surfactant (n) | 7 |
| | Amphoteric Surfactant (o) | 10 |
| Third layer | Lime-processed gelatin | 240 |
| | water-soluble polymer (k) | 24 |
| | Hardener (p) | 180 |
| | Surfactant (e) | 9 |
| Second layer | Lime-processed gelatin | 2400 |
| | Water-soluble polymer (k) | 120 |
| | Water-soluble polymer (q) | 700 |
| | Water-soluble polymer (r) | 600 |
| | High boiling point solvent (s) | 2000 |
| | Additive A | 1270 |
| | Additive B | 683 |
| | Additive C | 1113 |
| | Anionic Surfactant (e) | 20 |
| First layer | Gelatin | 280 |
| | Water soluble polymer (j) | 12 |
| | Anionic Surfactant (g) | 14 |
| | Hardener (p) | 185 |

Additive A

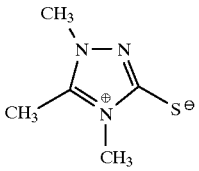

Additive B

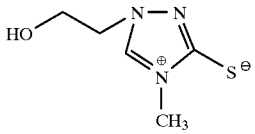

Additive C

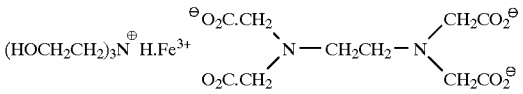

The transmission densities of samples 101–112 were evaluated and a characteristic curve was plotted. Sensitivity is expressed in a relative value which is 100 times the value obtained as a quotient of the reciprocal of an exposure value, at a density 0.15 higher than fogging density, divided by the reciprocal obtained on the same basis for the Sample 101. The relative sensitivity, maximum density and level of fogging of the images obtained here are shown in table 7.

TABLE 7

| Sample | Relative sensitivity | Maximum density | Fogging density | Reference |
|---|---|---|---|---|
| 101 | 100 | 2.90 | 0.28 | C.E. |
| 102 | 325 | 2.90 | 0.29 | C.E. |
| 103 | 270 | 2.05 | 0.26 | C.E. |
| 104 | 408 | 2.90 | 0.28 | C.E. |
| 105 | 85 | 2.93 | 0.20 | C.E. |
| 106 | 282 | 2.92 | 0.17 | P.I. |
| 107 | 253 | 2.07 | 0.20 | C.E. |
| 108 | 334 | 2.90 | 0.16 | P.I. |
| 109 | 250 | 2.90 | 0.16 | P.I |
| 110 | 286 | 2.90 | 0.18 | P.I |
| 111 | 270 | 2.90 | 0.16 | P.I |
| 112 | 291 | 2.85 | 0.17 | P.I |

C.E. = comparative example
P.I. = present invention

Apart from changing the processing material used in the processing of samples 101–112 to processing material p-12, image formation processing was carried out in the same way as before. The relative sensitivity, maximum density, and fogging density of the images obtained are shown in table 8.

TABLE 8

| Sample | Relative sensitivity | Maximum density | Fogging density |
|---|---|---|---|
| 101 | 90 | 2.89 | 0.21 |
| 102 | 305 | 2.90 | 0.19 |
| 103 | 255 | 2.07 | 0.21 |
| 104 | 382 | 2.91 | 0.19 |
| 105 | 78 | 2.91 | 0.17 |
| 106 | 257 | 2.90 | 0.14 |
| 107 | 221 | 2.07 | 0.18 |
| 108 | 307 | 2.91 | 0.13 |
| 109 | 239 | 2.92 | 0.13 |
| 110 | 259 | 2.91 | 0.14 |
| 111 | 249 | 2.91 | 0.14 |
| 112 | 263 | 2.86 | 0.14 |

From tables 7 and 8, it can be seen that when light-sensitive materials obtained (samples 101–112) were compared, the samples 102–104 exhibited higher sensitivity than sample 101 did. With sample 103, employing silver iodobromide emulsion, color development in the 15 second, short first process was poor, and sensitivity was low compared to samples 102 and 104.

Next, the fogging values of light-sensitive materials (samples 101–108) were compared. The heat developable silver halide color photographic light-sensitive material of the present invention (samples 106 and 108) showed extremely low fogging levels compared to other light-sensitive materials (samples 105 and 107). This means that, in heat development employing coupling, the fogging prevention effect of compounds used in the present invention and expressed by the formulas (I)–(IV) is displayed far more significantly with silver bromide tabular emulsions than it is with either silver chloride cubic emulsions or silver bromide tabular emulsions.

From comparisons of fogging levels of the heat developable silver halide color photographic light-sensitive materials of the present invention (samples 106 and 108), it can be seen that antifogging is more pronounced with silver halide color photographic light-sensitive materials having large aspect ratios.

It can be seen through comparison with the light-sensitive materials of the comparative examples sample 101), that the heat developable silver halide color photographic light-sensitive materials of the present invention (samples 106 and 108–112) have high sensitivity and low fogging, and thus the objectives of this invention are fulfilled.

Next, when the results of the light-sensitive material (sample 101) processed using processing material P-11, and the light-sensitive material (sample 101–112) processed using processing material P-12 were compared, it was found that images of the light-sensitive material (samples 102, 103, 106, 107, and 109–112 processed using the process material P-12 had high sensitivity and low fogging; the objectives of the present invention were fulfilled. To put it another way, the addition of the compounds expressed by formulas (I)–(IV) to the processing material, or to both the light-sensitive material and the processing material has the same effect as adding them to the light-sensitive material.

Example 2

Apart from changing the silver potential at the time of grain formation, light-sensitive silver halide emulsions B-3g and C-3g containing grains with aspect ratios (grain diameter/thickness ratio) of 15 and 8 respectively, were prepared in the same way that the light-sensitive silver halide emulsion A-3g was prepared in Example 1 (molar ratio of sensitizing dyes for red-sensitive emulsion is V:VI:VII=40:2:5).

The spectrally sensitized dyes used in the spectral sensitization of the light-sensitive silver halide emulsions A-3g, B-3g and C-3g were changed to the following: (sensitizing dye IV for blue-sensitive emulsions, sensitizing dyes V–VIII for red-sensitive emulsions), and blue-sensitive emulsions (A-3b, B-3b, and C-3b ) and red-sensitive emulsions (B-3r and C-3r) were prepared.

Also, cyan and yellow coupler dispersions were prepared in accordance with the preparation method of the coupler dispersion of Example 1. The compounds used are listed below.

In order to form a coloring layer capable of fading at the time of the heat developing process, yellow, magenta and cyan leuco-dyes and a zinc complex, all listed below, were mixed together and a coloring dispersion was prepared.

Sensitizing dye IV for blue-sensitive emulsion

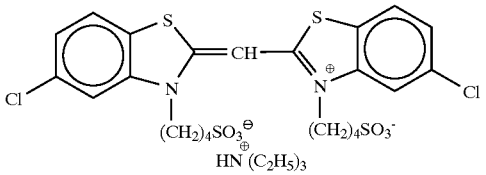

-continued

Sensitizing dye V for red-sensitive emulsion

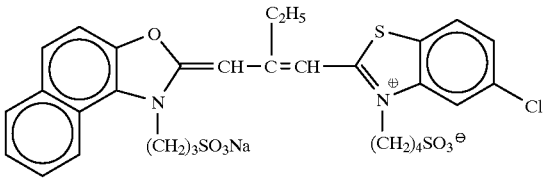

Sensitizing dye VI for red-sensitive emulsion

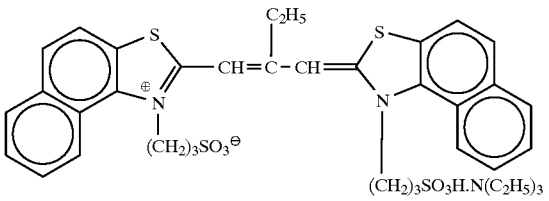

Sensitizing dye VII for red-sensitive emulsion

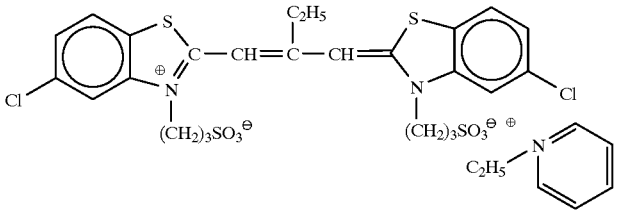

By use of the light-sensitive silver halide emulsion, coupler dispersion, and coloring agent dispersion obtained in this manner, a multilayer structured heat developable silver halide color photographic light-sensitive material was produced. The details of this multilayered heat developable silver halide color photographic light-sensitive material are given in tables 9 to 11. For reasons of convenience, one table has been divided into three, 9 to 11.

TABLE 9

| Layer | Main elements | Coating amount ($mg/m^2$) |
|---|---|---|
| Protective layer | Lime-processed gelatin | 1000 |
| | Matting agent (silica) | 50 |
| | Surfactant (f) | 100 |
| | Surfactant (g) | 300 |
| | Water-soluble polymer (h) | 15 |
| | Hardener (i) | 91 |
| Intermediate layer | Lime-processed gelatin | 375 |
| | Surfactant (g) | 15 |
| | Zinc hydroxide | 1100 |
| | Water-soluble polymer (h) | 15 |
| Yellow dye forming layer | Lime-processed gelatin | 150 |
| | Emulsion (based on the amount of coated silver) | A-3b 647 |
| | Yellow coupler (u) | 57 |
| | Developing agent (v) | 41 |
| | High boiling point organic solvent (d) | 50 |
| | Surfactant (g) | 3 |
| | Water-soluble polymer (h) | 1 |
| Yellow dye forming layer | Lime-processed gelatin | 220 |
| | Emulsion (based on the amount of coated silver) | B-3b 475 |
| | Yellow coupler (u) | 84 |

TABLE 9-continued

| Layer | Main elements | Coating amount ($mg/m^2$) |
|---|---|---|
| | Developing agent (v) | 60 |
| | High boiling point organic solvent (g) | 74 |
| | Surfactant (g) | 4 |
| | Water-soluble polymer (h) | 2 |
| Yellow dye forming layer | Lime-processed gelatin | 1400 |
| | Emulsion (based on the amount of coated silver) | C-3b 604 |
| | Yellow coupler (u) | 532 |
| | Developing agent (v) | 382 |
| | High boiling point organic solvent (d) | 469 |
| | Surfactant (g) | 23 |
| | Water-soluble polymer (h) | 10 |
| Intermediate layer | Lime-processed gelatin | 750 |
| | Surfactant (e) | 15 |
| | Leuco dye (x) | 303 |
| | Color developer (y) | 433 |
| | Water-soluble polymer (h) | 15 |

TABLE 10

| Layer | Main element | Coating amount ($mg/m^2$) |
|---|---|---|
| Magenta dye forming layer | Lime-processed gelatin | 150 |
| | Emulsion (based on the amount of coated silver) | A-3g 647 |
| | Magenta coupler (a) | 48 |
| | Developing agent (b) | 33 |

TABLE 10-continued

| Layer | Main element | Coating amount ($mg/m^2$) |
|---|---|---|
| | High boiling point organic solvent (d) | 50 |
| | Surfactant (e) | 3 |
| | water-soluble polymer (h) | 1 |
| Magenta forming layer | Lime-processed gelatin | 220 |
| | Emulsion (based on the amount of coated silver) | B-3g 475 |
| | Magenta coupler (a) | 70 |
| | Developing agent (b) | 49 |
| | High boiling point organic solvent (d) | 74 |
| | Surfactant (e) | 4 |
| | Water-soluble polymer (h) | 2 |
| Magenta forming layer | Lime-processed gelatin | 1400 |
| | Emulsion (based on the amount of coated silver) | C-3g 604 |
| | Magenta coupler (a) | 446 |
| | Developing agent (b) | 311 |
| | High boiling point organic solvent (d) | 469 |
| | Surfactant (e) | 23 |
| | Water-soluble polymer (h) | 10 |
| Intermediate layer | Lime-processed gelatin | 900 |
| | Surfactant (e) | 15 |
| | Leuco dye (z) | 345 |
| | Color developer (y) | 636 |
| | Zinc hydroxide | 1100 |
| | Water-soluble polymer (h) | 15 |
| Cyan dye forming layer | Lime-processed gelatin | 150 |
| | Emulsion (based on the amount of coated silver) | B-3r 647 |
| | Cyan coupler (aa) | 65 |
| | Developing agent (b) | 33 |
| | High boiling point organic solvent (d) | 50 |

TABLE 10-continued

| Layer | Main element | Coating amount ($mg/m^2$) |
|---|---|---|
| | Surfactant (e) | 3 |
| | Water-soluble polymer (h) | 1 |

TABLE 11

Transparent PET Base (120 $\mu$m)

| Layer | Main elements | Coating amount ($mg/m^2$) |
|---|---|---|
| Cyan dye forming layer | Lime-processed gelatin | 220 |
| | Emulsion (based on the amount of coated silver) | B-3r 475 |
| | Cyan coupler (aa) | 96 |
| | Developing agent (b) | 49 |
| | High boiling Point organic solvent (d) | 74 |
| | Surfactant (e) | 4 |
| | Water-soluble polymer (h) | 2 |
| Cyan dye forming layer | Lime-processed gelatin | 1400 |
| | Emulsion (based on the amount of coated silver) | C-3r 604 |
| | Cyan coupler (aa) | 610 |
| | Developing agent (b) | 311 |
| | High boiling point organic solvent (d) | 469 |
| | Surfactant (e) | 23 |
| | Water-soluble polymer (h) | 10 |
| Antihalation layer | Lime-processed gelatin | 750 |
| | Surfactant (e) | 15 |
| | Leuco dye (ab) | 243 |
| | Color developer (y) | 425 |
| | water-soluble polymer (h) | 15 |

Yellow coupler (u)

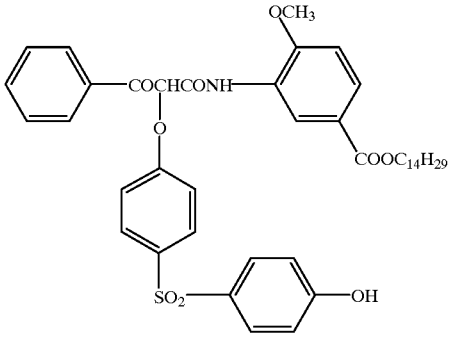

Developing agent (v)

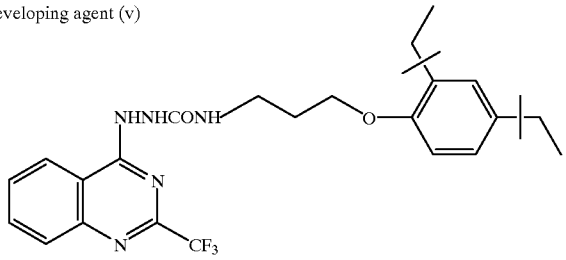

-continued

Cyan coupler (aa)

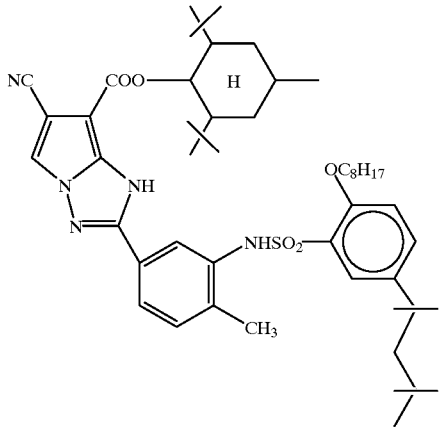

Leuco dye (ab)

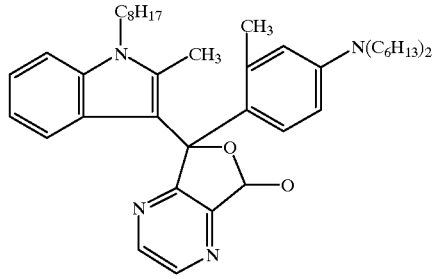

Leuco dye (x)

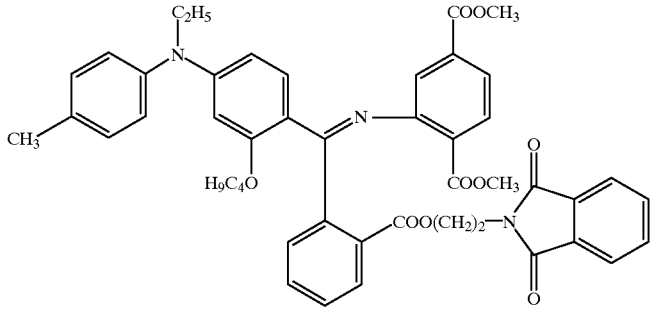

Color developer (y)

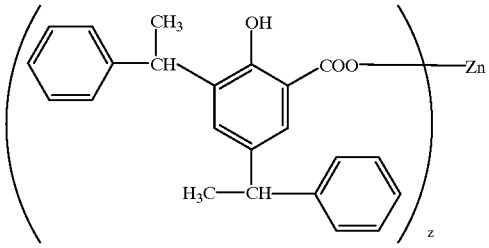

Leuco dye (z)

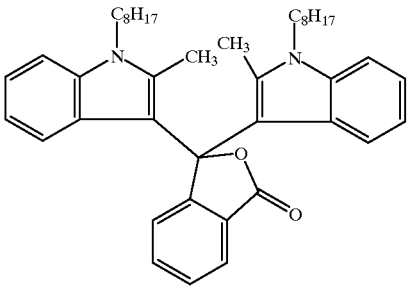

When the photographic qualities of these multilayer structured heat developable silver halide color photographic light-sensitive materials were tested in the same way as in Example 1, high quality, highly sensitive images with low levels of fogging were produced.

What is claimed is:

1. A heat developable silver halide color photographic light-sensitive material comprising a support having thereon photographic constituent layers which comprise at least one photographic light-sensitive layer comprising a light-sensitive silver halide emulsion, a developing agent, a color coupler capable of forming a cyan, magenta, or yellow dye by a coupling reaction with the oxidation product of the developing agent, and a binder, wherein at least one photographic constituent layer contains at least one of the compounds represented by formula (I), (II), (III), (IV), or (A-33) below, and wherein at least 50% of the total projected area of silver halide grains contained in the light-sensitive silver halide emulsion is taken up by tabular silver halide grains at least 50% of which are composed of silver chloride, and wherein the tabular silver halide grains have main outer surfaces composed of (100) planes;

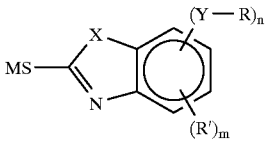

Formula (I)

wherein Y represents —$N(R_1)$—$SO_2$—, —$N(R_2)$—$SO_2$—$N(R_3)$— or —$N(R_4)$—CO—$N(R_5)$—, R represents an alkyl group, an alkenyl group, a cycloalkyl group, an aryl group, or an aralkyl group; X represents —O—, —S— or —$N(R_6)$—; M represents a hydrogen atom, an alkali metal atom, an ammonium group, or a group that cleaves under alkaline conditions; R' represents a hydrogen atom, or a group substitutable for a hydrogen atom; $R_1$–$R_6$ represent hydrogen atoms or alkyl groups; n represents 0, 1, or 2; m represents 4-n;

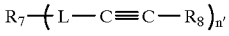

Formula (II)

wherein L represents a single bond or a divalently bonded group, n' represents an integer of 1–4, when n' is 1, $R_7$ is a carboxyl group, an alkyl group, a cycloalkyl group, an alkenyl group, an alkynyl group, an aralkyl group, an aryl group, or a heterocyclic group; when n' is 2, 3, or 4, $R_7$ represents a di, tri, or tetravalent residue; $R_8$ represents a hydrogen atom, a carboxyl atom, an alkyl group, a cycloalkyl group, an alkenyl group, an alkynyl group, an aralkyl group, an aryloxycarbonyl group, an alkoxycarbonyl group, an aryl group, a heterocyclic group, or a carbamoyl group; when n' is 2, 3, or 4, a group —L—C≡C—$R_8$ may all be the same or different, but not when L is a single bond and n'=1;

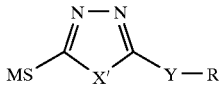

Formula (III)

wherein X' represents O—O, —S—, or —NH—; Y, R and M represent the same as they represented respectively in the Formula (I);

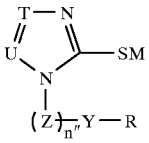

Formula (IV)

wherein T and U represent =C($R_9$)— or —N=; $R_9$ represents a hydrogen atom, a halogen atom, a hydroxy group, a nitro group, an alkyl group, an alkenyl group, an aralkyl group, an aryl group, a carboxylic acid amide group, a sulfonamide group, a ureide group, or a thioureide group; Z represents an alkylene group, an alkenylene group, an aralkylene group, or an arylene group; n" represents 0 or 1, Y, R, and M represent the same as they do respectively in the Formula (I);

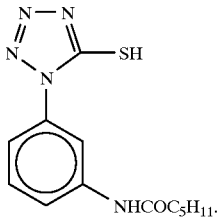

Formula (A-33)

2. A heat developable silver halide color photographic light-sensitive material according to claim 1, wherein at least one photographic constituent layer contains at least one of the compounds represented by the above formula (I) or (II).

3. A heat developable silver halide color photographic light-sensitive material according to claim 1, wherein the tabular silver halide grains have main outer surface composed of a (100) plane and have an aspect ratio of more than 2, and a projected plane thereof is in the shape of a rectangle having a length to breadth ratio of from 1:1 to 1:2.

4. A heat developable silver halide color photographic light-sensitive material according to claim 1, which forms color images through the plying of a processing material comprising a support having thereon a constituent layer comprising a processing layer which contains a base and/or a base precursor so that the light-sensitive layer comes into contact with the processing layer under water, and through heat development.

5. A heat developable silver halide color photographic light-sensitive material according to any of claims 1 to 4, wherein the developing agent is any of the compounds represented by the following formulas:

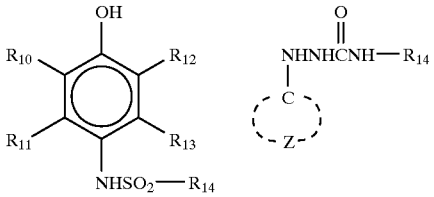

wherein $R_{10}$–$R_{13}$ represent a hydrogen atom, a halogen atom, an alkyl group, an aryl group, an alkyl carboxylic acid amide group, an aryl carboxylic acid amide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_{14}$ represents an alkyl group, an aryl group, or a heterocyclic compound; Z represents a group of atoms forming a (heterocyclic) aromatic ring, when Z is a benzene ring, the total value of the Hammet constant (σ) of the substituted group is more than 1, and these compounds have at least one ballast group of at least 8 carbons.

6. A heat developable silver halide color photographic light-sensitive material according to claim 1, wherein the compounds expressed by the formula (I), (II), (III), or (IV) are added in an amount of $10^{-7}$–$10^{-1}$ moles per mole of light-sensitive silver halide.

7. A heat developable silver halide color photographic light-sensitive material according to claim 1, wherein the amount of the light-sensitive silver halide emulsion present is from 1 mg/$m^2$ to 10 g/$m^2$, based on the weight of silver.

8. A heat developable silver halide color photographic light-sensitive material according to claim 1, wherein the amount of binder applied is 1–20 g/$m^2$.

9. A heat developable silver halide color photographic light-sensitive material according to claim 1, wherein the color coupler capable of forming a cyan, magenta, or yellow dye by a coupling reaction with the oxidation product of the developing agent is added in an amount of 1/1000–1 mole per mole of silver halide.

10. A method of forming color images comprising: exposing a heat developable silver halide color photographic light sensitive material which comprises a support and photographic constituent layers formed thereon, said photographic constituent layers comprising at least one light-sensitive layer, said light-sensitive layer containing a light-sensitive silver halide emulsion, a developing agent, a color coupler capable of forming a cyan, magenta, or yellow dye by a coupling reaction with the oxidation product of the developing agent, and a binder; supplying water to the light-sensitive surface of the heat developable silver halide color photographic light-sensitive material or a processing surface of a processing material comprising a support and a constituent layer thereon which comprises the processing layer containing a base or a base precursor, in an amount ranging from 1/10 to the equivalent of an amount which is required for the maximum swelling of all the coated layers of these materials; plying the light-sensitive material and the processing material so that the light-sensitive surface comes into contact with the processing surface; and heat developing the materials to form a color image;

wherein at least 50% of total projected area of silver halide grains contained in said light-sensitive silver halide emulsion of said heat developable silver halide color photographic light-sensitive material is taken up by tabular silver halide grains at least 50% of which are composed of silver chloride, and wherein the tabular silver halide grains have main outer surfaces composed of (100) planes, and wherein said heat developing is carried out under at least one compound represented by formula (I), (II), (III), (IV) or (A-33);

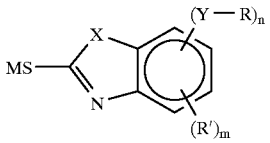

Formula (I)

wherein Y represents —N($R_1$)—$SO_2$—, —N($R_2$)—$SO_2$—N($R_3$)— or —N($R_4$)—CO—N($R_5$)—, R represents an alkyl group, an alkenyl group, a cycloalkyl group, an aryl group, or an aralkyl group; X represents O—O, —S— or —N($R_6$)—; M represents a hydrogen atom, an alkali metal atom, an ammonium group, or a group that cleaves under alkaline conditions; R' represents a hydrogen atom, or a group substitutable for a hydrogen atom; $R_1$–$R_6$ represent hydrogen atoms or alkyl groups; n represents 0, 1, or 2; m represents 4-n;

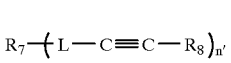

Formula (II)

wherein L represents a single bond or a divalently bonded group, n' represents an integer of 1–4, when n' is 1, $R_7$ is a carboxyl group, an alkyl group, a cycloalkyl group, an alkenyl group, an alkynyl group, an aralkyl group, an aryl group, or a heterocyclic group; when n' is 2, 3, or 4, $R_7$ represents a di, tri, or tetravalent residue; $R_8$ represents a hydrogen atom, a carboxyl atom, an alkyl group, a cycloalkyl group, an alkenyl group, an alkynyl group, an aralkyl group, an aryloxycarbonyl group, an alkoxycarbonyl group, an aryl group, a heterocyclic group, or a carbamoyl group; when n' is 2, 3, or 4, a group —L—C≡C—$R_8$ may all be the same or different, but not when L is a single bond and n'=1;

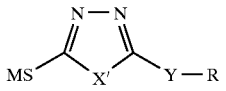

Formula (III)

wherein X' represents O—O, —S—, or —NH—; Y, R and M represent the same as they represented respectively in the Formula (I);

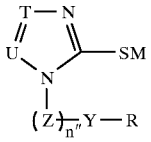

Formula (IV)

wherein T and U represent =C($R_9$)— or —N=; $R_9$ represents a hydrogen atom, a halogen atom, a hydroxy group, a nitro group, an alkyl group, an alkenyl group, an aralkyl group, an aryl group, a carboxylic acid amide group, a sulfonamide group, an ureide group, or a thioureide group; Z represents an alkylene group, an alkenylene group, an aralkylene group, or an arylene group; n" represents 0 or 1, Y, R, and M represent the same as they do respectively in the Formula (I);

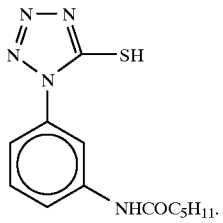

Formula (A-33)

11. A heat developable silver halide color photographic light-sensitive material comprising a support having thereon photographic constituent layers which comprise at least one photographic light-sensitive layer comprising a light-sensitive silver halide emulsion, a developing agent, a color coupler capable of forming a cyan, magenta, or yellow dye by a coupling reaction with the oxidation product of the developing agent, and a binder, wherein at least one photographic constituent layer contains at least one of the compounds represented by formula (II) below, and wherein at least 50% of the total projected area of silver halide grains contained in the light-sensitive silver halide emulsion is taken up by tabular silver halide grains at least 50% of which are composed of silver chloride, wherein the tabular silver halide grains have a outer surfaces composed of (100) planes;

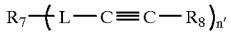

Formula (II)

wherein L represents a single bond or a divalently bonded group, n' represents an integer of 1–4, when n' is 1, $R_7$is a carboxyl group, an alkyl group, a cycloalkyl group, an alkenyl group, an alkynyl group, an aralkyl group, an aryl group, or a heterocyclic group; when n' is 2, 3, or 4, $R_7$represents a di, tri, or tetravalent residue; $R_8$represents a hydrogen atom, a carboxyl atom, an alkyl group, a cycloalkyl group, an alkenyl group, an alkynyl group, an aralkyl group, an aryloxycarbonyl group, an alkoxycarbonyl group, an aryl group, a heterocyclic group, or a carbamoyl group; when n' is 2, 3, or 4, a group —L—C≡C—$R_8$ may all be the same or different, but not when L is a single bond and n'=1.

* * * * *